US010806173B2

(12) United States Patent
Tully

(10) Patent No.: US 10,806,173 B2
(45) Date of Patent: Oct. 20, 2020

(54) METHOD AND APPARATUS FOR CUSTOM ROLLING A SMOKABLE PRODUCT

(71) Applicant: Blunt Wrap U.S.A., Inc., Mandeville, LA (US)

(72) Inventor: Ron Tully, Mountain Lakes, NJ (US)

( * ) Notice: Subject to any disclaimer, the term of this patent is extended or adjusted under 35 U.S.C. 154(b) by 0 days.

(21) Appl. No.: 16/172,971

(22) Filed: Oct. 29, 2018

(65) Prior Publication Data

US 2019/0133180 A1 May 9, 2019

Related U.S. Application Data

(63) Continuation of application No. 15/167,245, filed on May 27, 2016, now Pat. No. 10,111,460.

(60) Provisional application No. 62/181,876, filed on Jun. 19, 2015.

(51) Int. Cl.

| | |
|---|---|
| ***A24D 1/02*** | (2006.01) |
| ***A24C 1/28*** | (2006.01) |
| ***A24C 1/34*** | (2006.01) |
| ***A24C 5/44*** | (2006.01) |
| ***A24F 17/00*** | (2006.01) |
| ***B65D 85/10*** | (2006.01) |
| ***B65D 85/12*** | (2006.01) |
| *B65D 33/16* | (2006.01) |

(52) U.S. Cl.

CPC ..... *A24D 1/022* (2013.01); *A24C 1/28* (2013.01); *A24C 1/34* (2013.01); *A24C 5/44* (2013.01); *A24F 17/00* (2013.01); *B65D 85/10* (2013.01); *B65D 85/12* (2013.01); *B65D 33/16* (2013.01)

(58) Field of Classification Search

CPC ..... A24C 5/40; A24C 5/44

See application file for complete search history.

(56) References Cited

U.S. PATENT DOCUMENTS

| | | | | |
|---|---|---|---|---|
| 680,003 | A * | 8/1901 | Simering | A24C 5/44 131/365 |
| 2002/0166561 | A1* | 11/2002 | Sinclair, Jr. | A24C 5/40 131/73 |
| 2006/0000481 | A1* | 1/2006 | Sinclair, Jr. | A24C 5/40 131/347 |

FOREIGN PATENT DOCUMENTS

| | | | | |
|---|---|---|---|---|
| WO | WO-2004086887 | A1 * | 10/2004 | A24C 5/40 |

* cited by examiner

*Primary Examiner* — Eric Yaary

(74) *Attorney, Agent, or Firm* — Roy Kiesel Ford Doody & North, APLC; Brett A. North

(57) ABSTRACT

A product and method of making thereof for the consumption of smokable substances such as tobacco or herbs. The product is comprised of smokable materials such as tobacco, homogenized tobacco, natural leaf materials, vegetable materials, herbal materials, paper, cellulose, and other smokable materials and has a connected form mandrel which is used during the rolling process and disconnected after substantial completion of the rolling process.

10 Claims, 20 Drawing Sheets

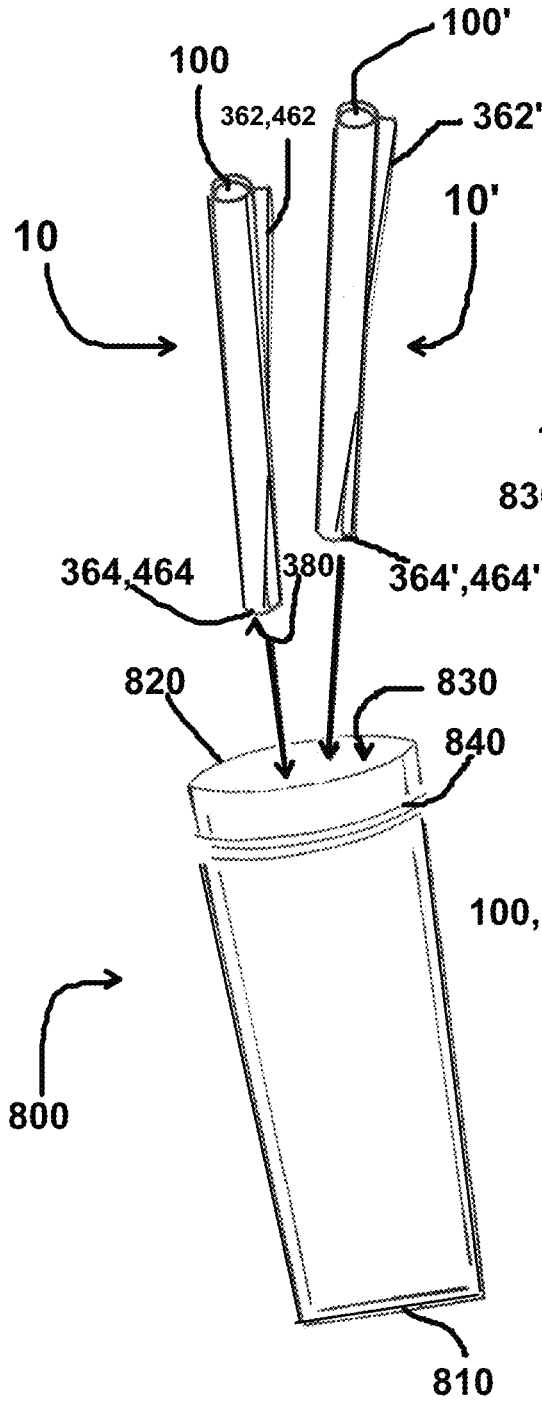
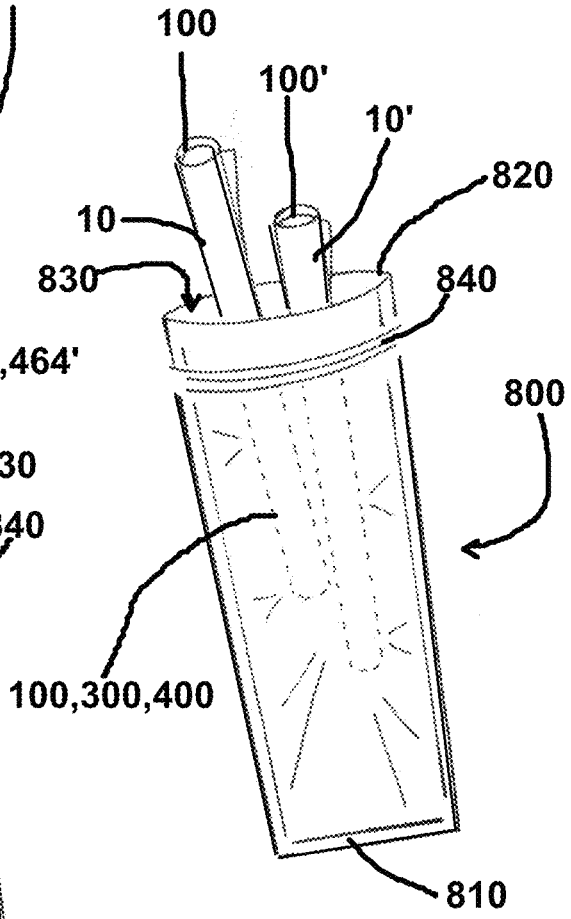
FIG. 5
FIG. 4

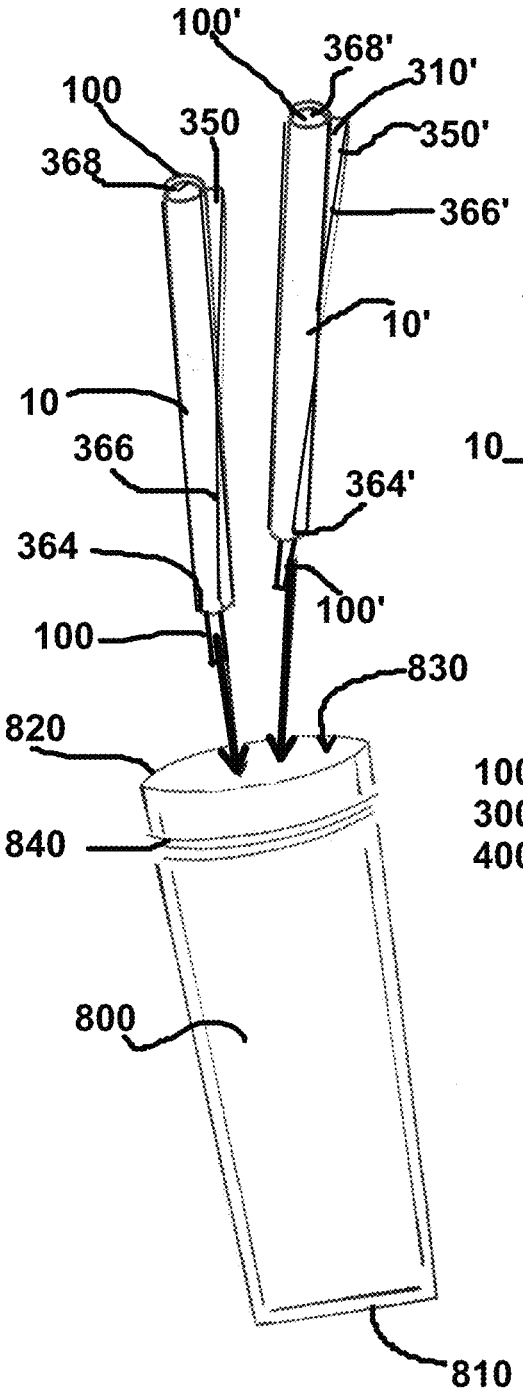
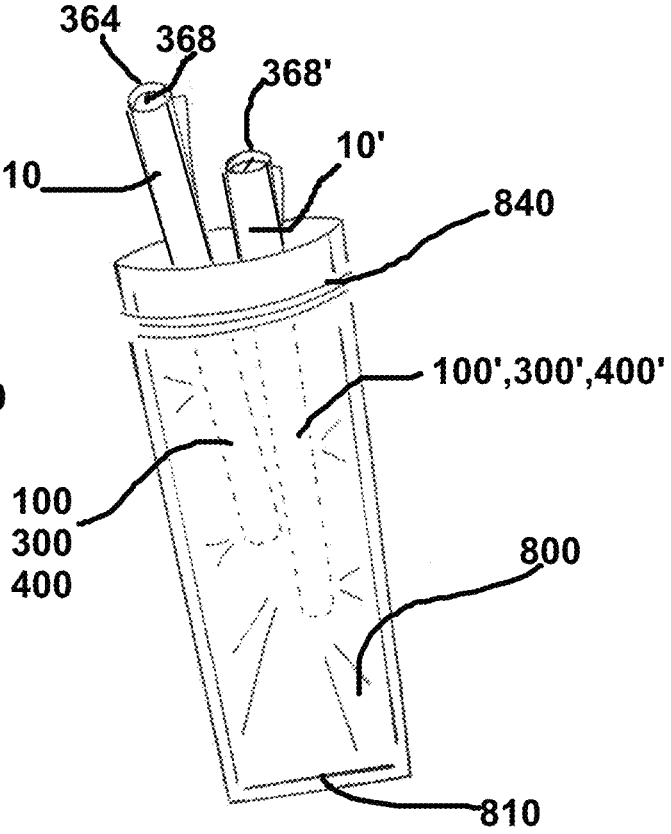
FIG. 19
FIG. 18

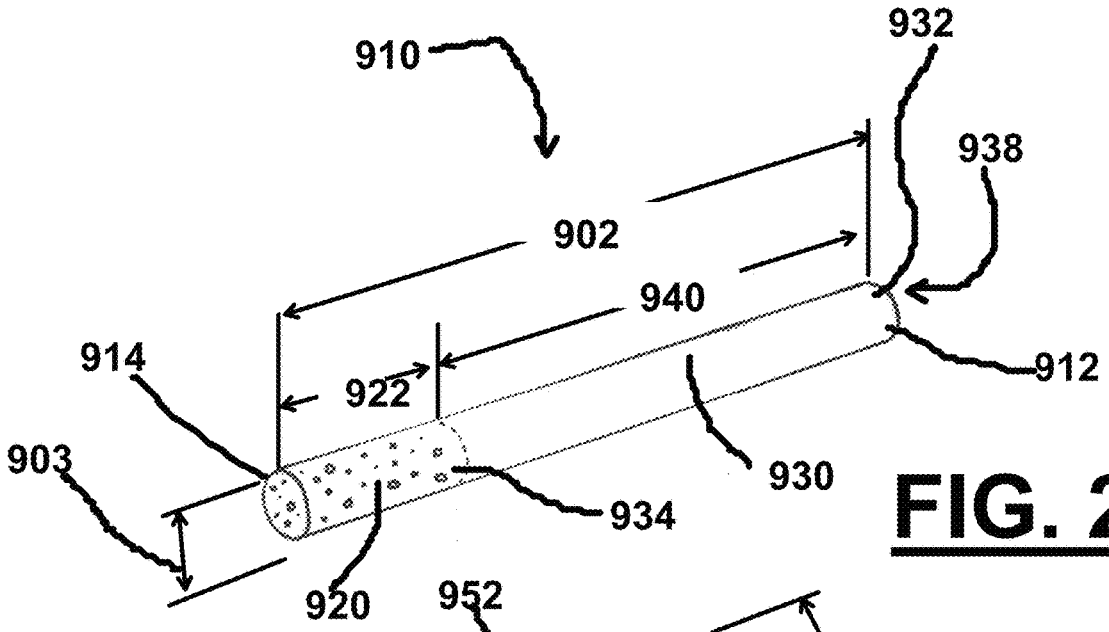
FIG. 28
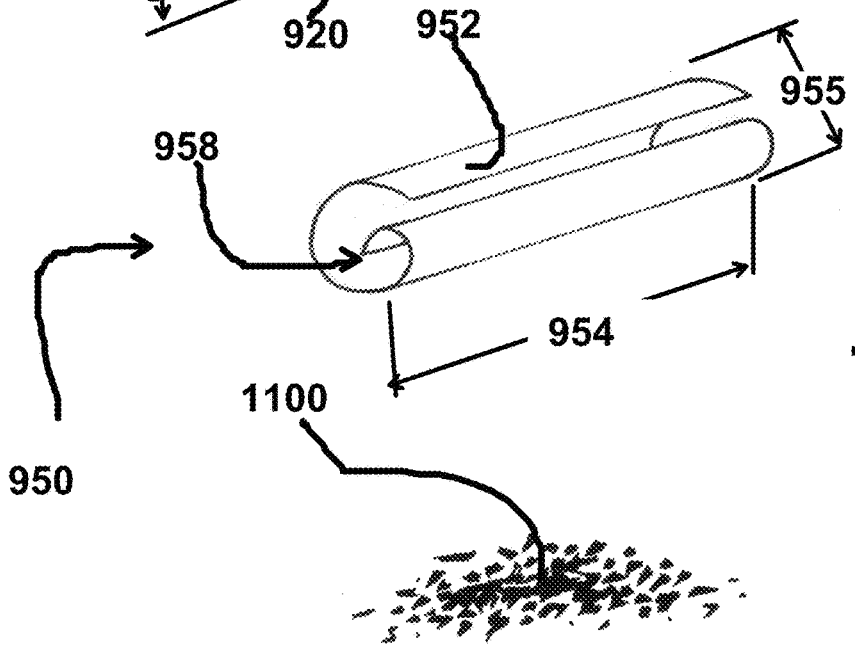
FIG. 29
FIG. 30

METHOD AND APPARATUS FOR CUSTOM ROLLING A SMOKABLE PRODUCT

CROSS-REFERENCE TO RELATED APPLICATIONS

This is a continuation of U.S. patent application Ser. No. 15/167,245 filed on May 27, 2018 (issuing as U.S. Pat. No. 10,111,460 on Oct. 30, 2018), which claims the benefit of U.S. provisional patent application Ser. No. 62/181,876, filed on Jun. 19, 2015, all of which applications are incorporated herein by reference and priority to/of all of which applications is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND

Many cigar smokers prefer to use their own tobacco product as opposed to purchasing cigars that are already constructed and filled with tobacco. These users of fine, custom tobacco prefer to start with an empty shell which they prefer to purchase and then fill with their own custom tobacco filler material or other smokable material after the shell has been removed from its package.

Patents have issued for cigar products or smokable products that begin with an empty shell that is packaged in an empty or less than filled condition, thus enabling a smoker to later add his or her custom tobacco filler. For example, the Sinclair U.S. Pat. Nos. 6,321,755; 6,357,448; 6,526,986; and 7,717,119, each hereby incorporated herein by reference disclose tobacco shells that are packaged empty of contents so that a user can add his or her custom tobacco or other fill material to the shell after opening the package.

BRIEF SUMMARY

In various embodiments the present invention relates to kits for preparing smoking articles such as cigars, cigarillos, and other smokable products.

More particularly, in various embodiments the present invention relates to an improved kit including at least one smokable sheet and at least one form mandrel detachably connected to said smokable sheet, the kit being used for rolling a custom made cigar, cigarillo, and/or rolled smoking article.

In various embodiments the kit can be packaged for sale wherein the kit includes;

(a) at least one form mandrel;

(b) at least one smokable sheet, the at least one smokable sheet being in a pre-rolled state, with a longitudinal containment volume and edges that can be moved apart to provide access to the containment volume for adding a smokable filler to the containment volume;

(c) the at least one form mandrel being connected to and supporting the at least one smokable sheet in the pre-rolled state; and (d) the at least one form mandrel and at least one smokable sheet being packaged for sale in packaging, such as in a pouch (e.g., a foil).

In various embodiments the connected at least one form mandrel can also be used during one or more steps of preparing a custom rolled smokable article such as:

(a) moving the edges apart to provide access to the containment volume;

(b) after step "a", adding a smokable filler to the containment volume while the edges are moved apart, and (c) after step "b", rolling the at least one pre-rolled sheet into a custom made cigar, cigarillo, and/or rolled smoking article, including maintaining a tensile force in the at least one pre-rolled sheet during this step.

After the filling and rolling process the connected form mandrel can be disconnected from the sheet and/or rolled smoking article.

In various embodiments is provided a product including a rolled smokable tube for holding an end user's smokable fill material, comprising:

(a) a form mandrel;

(b) a smokable tube comprising a sheet of material, the sheet of material being rolled into a shaped tube that has a longitudinal bore;

(c) a longitudinal opening in the sheet of material for adding smokable fill material to the bore, and edges that can be moved apart providing access to the bore so that the smokable fill material can be added to the bore;

(d) wherein the smokable tube is packaged for sale in a wrapper with a form mandrel being connected to and supporting smokable tube in the rolled state, and the smokable tube remains rolled in a tube shape inside the wrapper after packaging, and is not filled with smokable filler to form a complete rolled smokable article.

In various embodiments is provided a rolled smokable product, comprising:

(a) a first pre-rolled smokable sheet of material, the pre-rolled sheet having a longitudinal bore;

(b) a longitudinal opening in the first pre-rolled sheet for adding smokable fill material to the longitudinal bore, and edges that can be moved apart to enlarge the longitudinal opening so that the smokable fill material can be added to the bore via the enlarged longitudinal opening;

(c) wherein the pre-rolled smokable sheet is packaged in the wrapper with a form mandrel being connected to and supporting the pre-rolled sheet in the rolled state, and the pre-rolled sheet remaining pre-rolled inside the wrapper after packaging, and is not filled with smokable filler to form a complete rolled smokable article.

In various embodiments is provided a method of constructing a rolled smokable product comprising the steps of:

(a) obtaining a sheet of smokable material wherein the sheet is connected to a form mandrel, and the sheet is rolled into a shaped tube that has an interior bore and at least two edges that can be moved apart providing access to the interior bore so that smokable fill material can be added to the interior bore;

(b) wherein, without filling the interior bore with smokable fill material, the shaped tube and connected form mandrel is packaged inside a wrapper for sale to a consumer, with the form mandrel supporting the pre-rolled sheet in the rolled state inside the wrapper;

(c) constructing a rolled smokable product from the shaped tube of step "b" by removing the shaped tube and connected form mandrel from the wrapper, moving apart the two edges, and filling the interior bore with smokable fill material, and using the connected form mandrel to roll to the sheet and smokable fill material into a rolled smokable product.

In various embodiments is provided a method of constructing a rolled smokable product comprising the steps of:

(a) providing a sheet of material that is comprised of smokable material, and connecting the sheet of material to a form mandrel;

(b) rolling the sheet of material around the form mandrel into a shaped tube that has a longitudinal bore and two edges that can be moved apart providing access to the interior bore so that smokable fill material can be added to the interior bore;

(c) packaging the shaped tube and connected form mandrel in a wrapper for sale to a consumer, and without filling the interior bore with smokable fill material; and (d) enabling a consumer to fabricate a rolled smokable product by removal of the shaped tube and connected form mandrel from the wrapper, moving apart the two edges, filling of the interior bore with smokable fill material, and using the connected form mandrel to roll the sheet of material and added smokable fill material into a rolled smokable product, and subsequently disconnecting the form mandrel from the sheet of material and completing the process of forming the finished rolled smokable product.

In various embodiments is provided a method of constructing a rolled smokable tube product comprising the steps of:

(a) providing a sheet of material that includes smokable material and connected form mandrel;

(b) rolling the sheet of material around the connected form mandrel into a shaped tube that has a longitudinal bore and two edges that can be moved apart so that smokable fill material can be added to the longitudinal bore;

(c) packaging the shaped tube and connected form mandrel in a wrapper for sale to a consumer and without filling the longitudinal bore with smokable fill material; and (d) wherein the connected shaped tube is to be used, after removal of the sheet of material from the wrapper and filling the longitudinal bore with smokable fill material, in rolling the sheet of material and smokable fill material into a rolled smokable tube product, with the form mandrel to be disconnected from the sheet of material only after this rolling process.

In various embodiments is provided a method of constructing a rolled smokable tube product filled with smokable filler comprising the steps of:

(a) obtaining a sheet comprised of smokable material, wherein the sheet is connected to a form mandrel and rolled into a shaped tube about the connected form mandrel, with the rolled sheet having an interior bore and two edges that can be moved apart to provide access to the interior bore and allow smokable fill material to be added to the interior bore, wherein the sheet and connected form mandrel are packaged in a wrapper for sale to a consumer, and without filling the interior bore with smokable fill material;

(b) removing the packaged rolled sheet and connected form mandrel from the wrapper, moving apart the two edges and filling the interior bore with smokable fill material, and using the connected form mandrel to construct a rolled smokable tube product by rolling the sheet with smokable filler into a rolled smokable tube whose interior bore is filled with smokable filler; and (c) after step "b" disconnecting the form mandrel from the sheet.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIGS. 4 and 5 show two rolled assemblies being inserted into a foil and resealable pouch.

FIGS. 18 and 19 show two rolled assemblies being inserted into a foil and resealable pouch.

FIG. 28 is a perspective view of a hollow receiving portion.

FIG. 29 is a perspective view of a sheet which can be used in making a smokable insert.

FIG. 30 is a perspective view of smokable filler.

DETAILED DESCRIPTION

Figure 1:
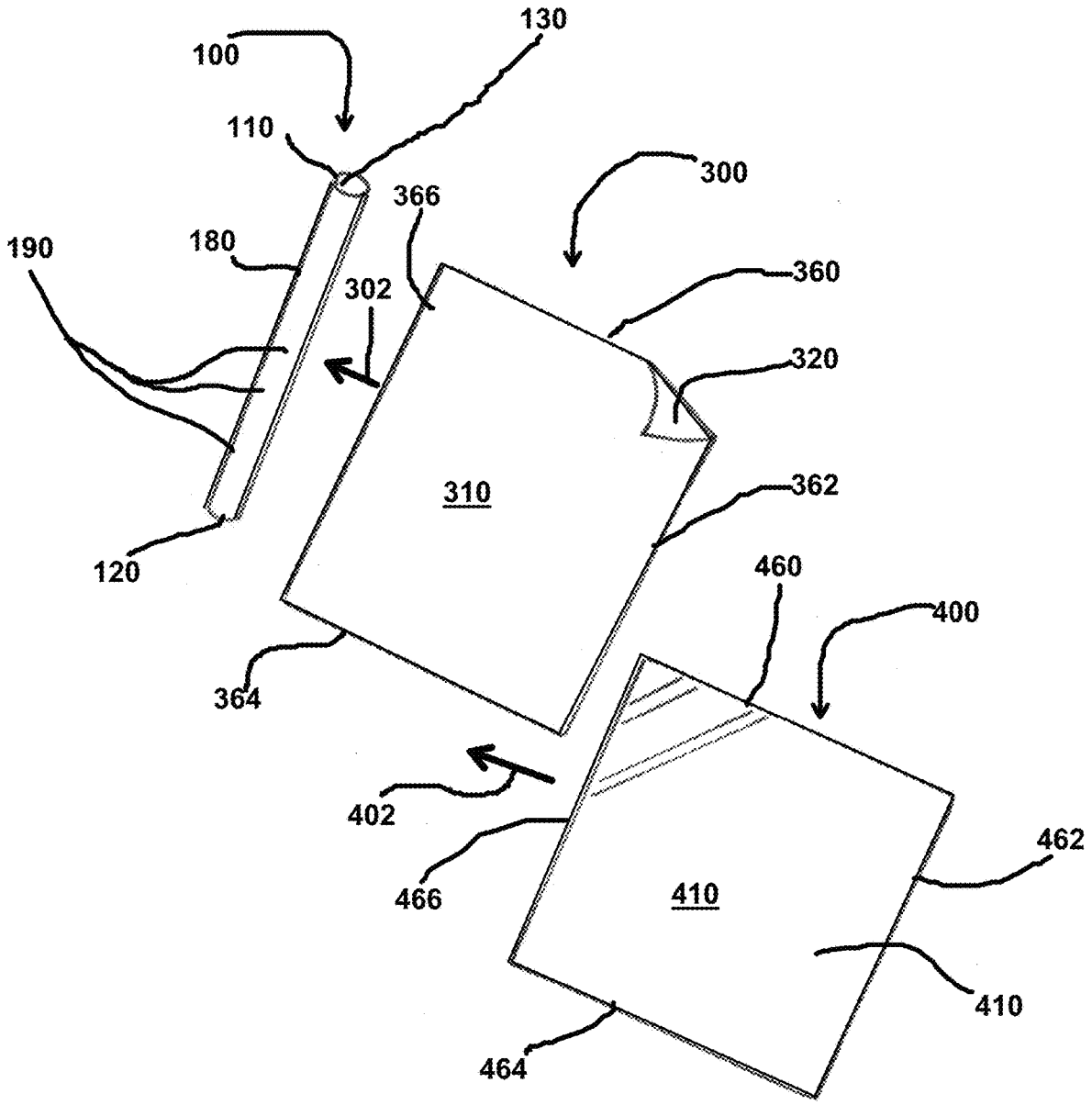
FIG. 1 schematically shows assembly of a first embodiment where the adhesive is attached to the straw.

Smokable article kit can include pre-rolled smokable sheet 300 having an interior bore 380, said sheet 300 being rolled around and connected to form mandrel or straw 100, with pre-rolled sheet 300 and connected form mandrel 100 being together packaged for sale in a flexible packaging 800 (such as a foil pouch) when pre-rolled smokable sheet 300 is not filled with smokable filler material 1100.

Form mandrel/straw 100 can include first end 110, second end 120 and have a longitudinal bore 130. About straw 100 can be an adhesive 190 which in a preferred embodiment can be a line of adhesive and is used to connect straw 100 to smokable sheet 300. Form mandrel can be constructed from any type of materials (preferably non-smokable materials) having the requisite properties including resistance to collapsing and supporting the pre-rolled state for pre-rolled sheet 300 including plastic, metal, wood, etc.

Smokable sheet 300 can include first face 310, second face 320, and have first 360, second 362, third 364, and fourth 366 sides. First 360, second 362, third 364, and fourth 366 sides can respectively have dimension 361, dimension 363, dimension 365, and dimension 367. Smokable sheet 300 can be constructed from any type of smokable materials including homogenized tobacco or HTM, natural leaves, cellulose, wood pulp, paper, rice paper, cigar paper, cigarette paper, vegetable, fruit, herb, etc.

Separating sheet 400 can include first face 410, second face 420, and have first 460, second 462, third 464, and fourth 466 sides. First 460, second 462, third 464, and fourth 466 sides can respectively have dimension 461, dimension 463, dimension 465, and dimension 467. Separating sheet 400 can be constructed from any type of materials (preferably non-smokable materials) having the requisite properties including cellophane, plastic, foil, etc.

Package or flexible wrapper 800 can be flexible and any shape such as rectangular. The package 800 has interior 830 that can be closed. The interior 830 can be sized and shaped to contain the combination of pre-rolled sheet 300 and connected form mandrel 100. The package or wrapper 830 has closed end 810 and open end 820 that would enable insertion of the combination of pre-rolled sheet 300, connected form mandrel 100 into the interior 830. A seal 840 could be formed at in order to encapsulate the combination pre-rolled sheet 300/connected form mandrel 100 into the interior 830.

Connected form mandrel/straw 100 can be used to prevent compression the pre-rolled smokable sheet 300 when packaged, and can further be used to assist in the rolling process as will be described below.

In various embodiments a non-smokable separating sheet 400 can be used to resist/prevent smokable sheet 300 from sticking to itself while in the interior 830 of packaging 800, along with retaining moisture in smokable sheet 300.

As will be described below, in various embodiments the apparatus 10 of the present invention enables a user or smoker to support his or her custom smokable filler into hollow interior 380 of pre-rolled smokable sheet 300 after it has been removed from package or wrapper 800.

Connection by Glue Line

FIG. 1 schematically shows assembly of a first embodiment where adhesive 190 is attached to the straw 100. This Figure schematically shows smokable sheet 300 being attached (schematically indicated by arrow 302) to straw 100, and separating sheet 400 being placed on smokable sheet 300 (schematically indicated by arrow 402).

Figure 2:
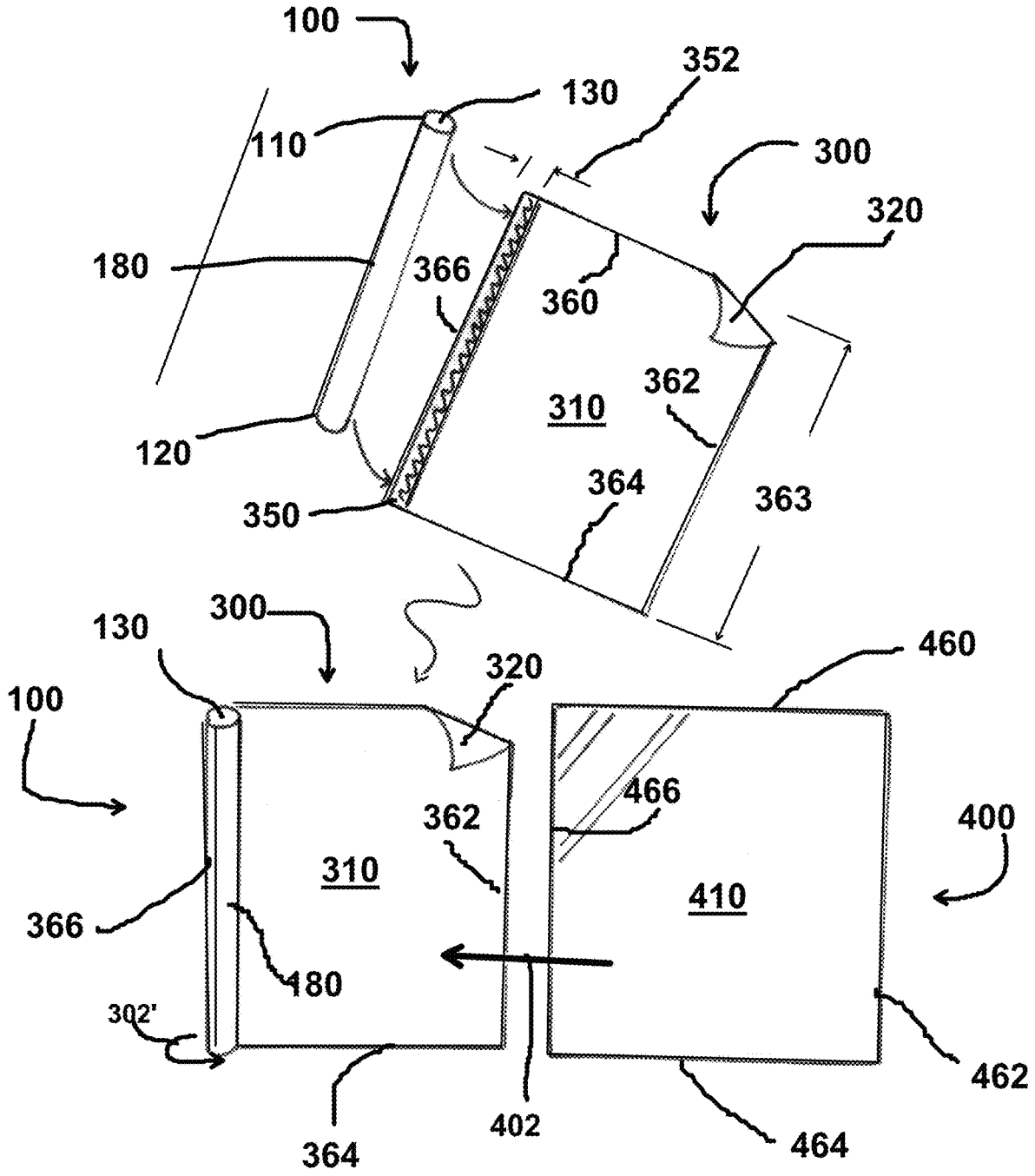
FIG. 2 schematically shows the straw being attached to the smokable sheet using an adhesive line, and then a separating sheet being placed over the smokable sheet.
Figure 3:
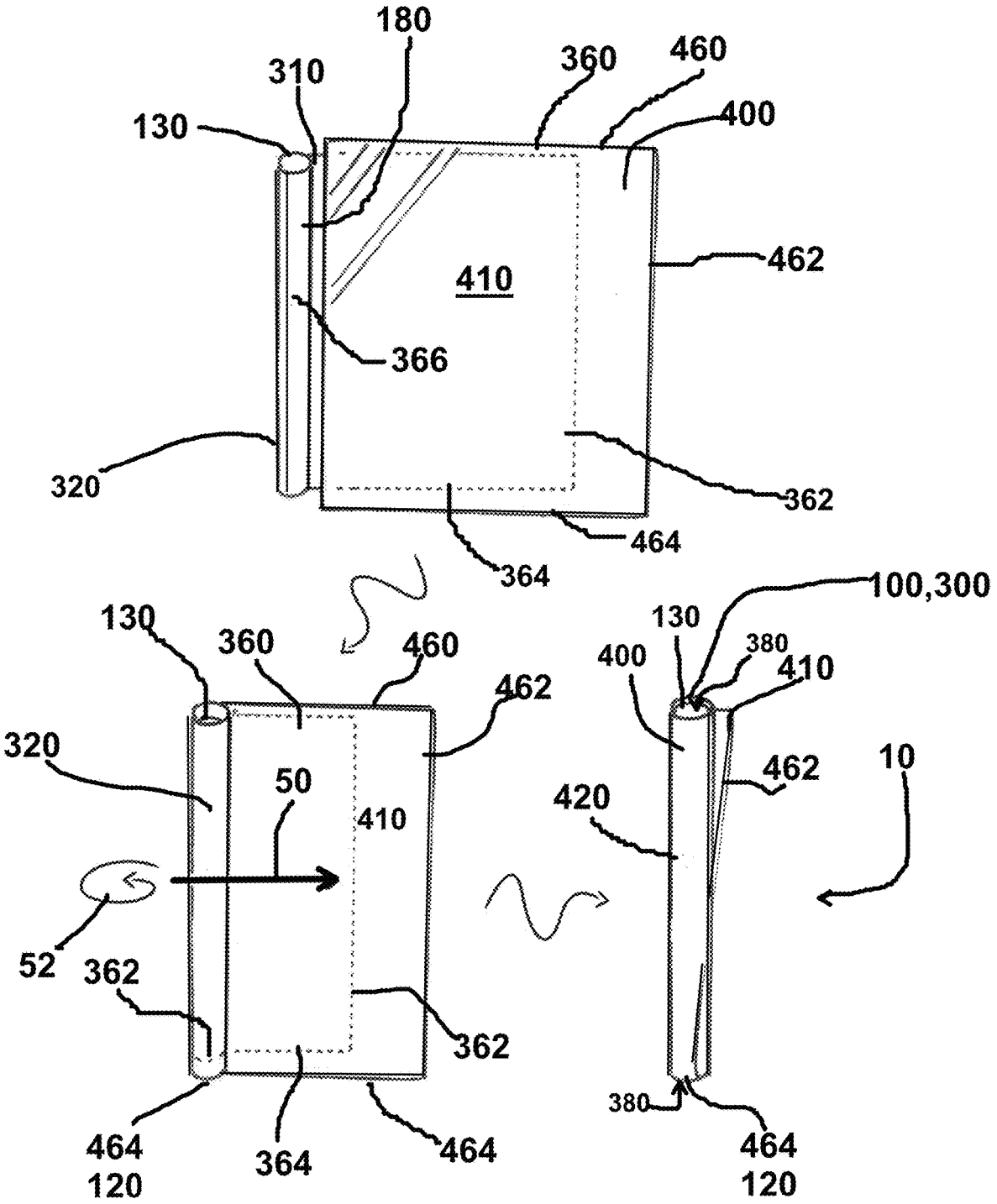
FIG. 3 schematically shows the straw now attached to the smokable sheet using an adhesive line with a separating sheet being placed over the smokable sheet, and then showing the assembly being rolled to form a rolled assembly.

FIG. 2 schematically shows an alternative embodiment where adhesive or glue 350 having a width 130 is placed on smokable sheet 300 (at edge 366) instead of on form mandrel/straw 100. This Figure schematically shows smokable sheet 300 being attached to straw 100 and partially rolled about straw 100 (schematically indicated by arrow 52') along with separating sheet 400 being placed on smokable sheet 300 (schematically indicated by arrow 402). FIG. 3 schematically shows the straw 100 now attached to the smokable sheet 300 using an adhesive line 350 with a separating sheet 400 being placed over the smokable sheet 300, and then showing the assembly being rolled 100 (schematically indicated by arrow 52") to form a rolled assembly 10. FIGS. 4 and 5 show two rolled assemblies 10 and 10' being inserted into a foil and resealable pouch 800. Assembly 10' is constructed substantially similar to assembly 10. Each rolled assembly 10,10' can include pre-rolled smokable sheet 300 which is pre-rolled and attached to form mandrel/straw 100 with a separating sheet 400. The units 10 and 10' are now ready for sale to a consumer who desires to make his on custom made rolled smoking product.

FIGS. 6 through 15 schematically illustrate the steps for one embodiment in making a custom made rolled smoking product.

Figure 6:
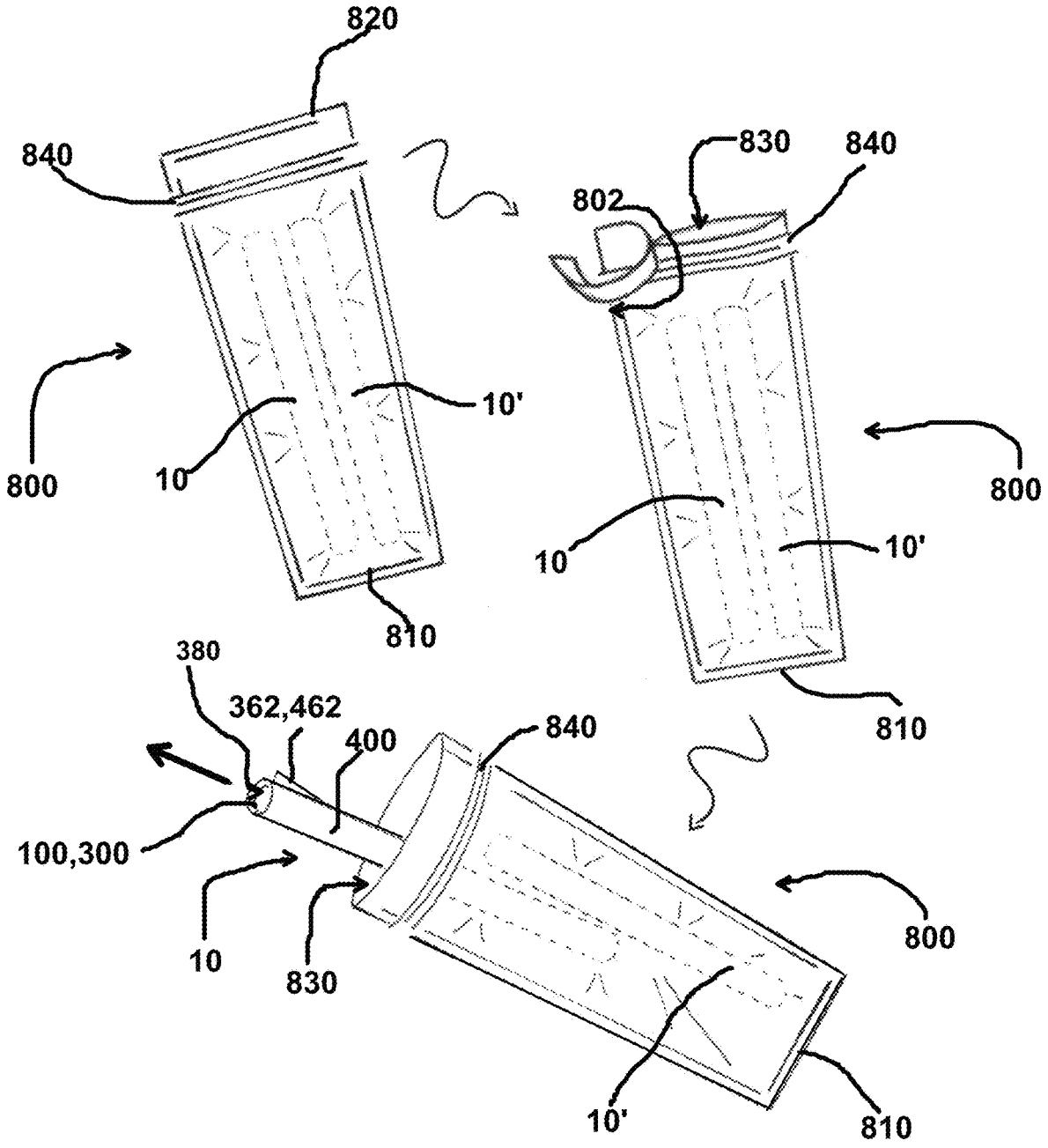
FIG. 6 schematically illustrates the steps to open the foil pouch and remove one of the rolled assemblies.

FIG. 6 schematically illustrates the steps to open the foil 800 pouch and remove one of the rolled assemblies 10 or 10'. Opening of the pouch schematically indicated by arrow 802.

Figures 7, 8, 9:
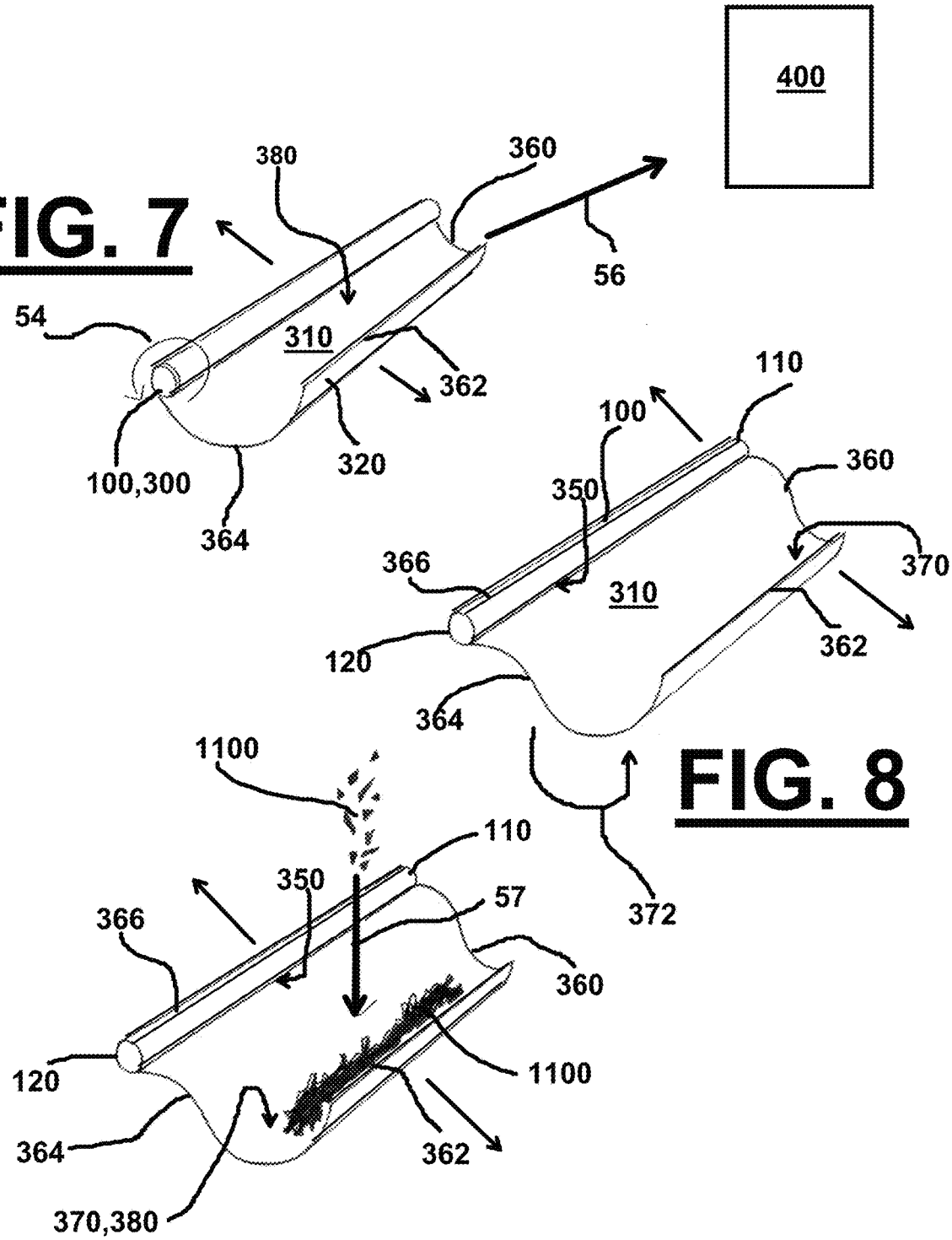
FIG. 7 shows one of the rolled assemblies being unrolled with the removal of the separating sheet.
FIG. 8 shows the rolled assembly now unrolled with a valley being formed from the memory in the smokable sheet from the previous rolling.
FIG. 9 schematically illustrates the step of adding smokable filler onto the smokable sheet where the sheet remains attached to a straw.

FIG. 7 shows one of the rolled assemblies 10, with edges 362 and 366 of sheet 300 being moved apart to at least partially unroll sheet 300, and with the removal of separating sheet 400. The moving apart and unrolling is schematically indicated by the arrows along with arrow 54, and the removal of separating sheet 400 is schematically indicated by arrow 56. During this moving apart and unrolling process, form mandrel/straw 100 remains connected to smokable sheet 300, such as by glue line 350. Also the pre-rolling of smokable sheet 300 about form mandrel/straw 100, with such pre-rolling causing pre-rolled sheet 300 to have a "rolling" memory wherein pre-rolled sheet will tend to want to roll up again into a cylinder.

FIG. 8 shows smokable sheet 300 connected to form mandrel 100 at edge 366 via glue line 350, and with edges 362 and 366 of sheet 300 being moved apart to provide access to interior bore 380, and at least partially unroll sheet 300, also creating a valley 372 from sheet 300's rolling memory. FIG. 9 schematically illustrates the step of adding smokable filler 1100 (schematically indicated by arrow 57) onto the smokable sheet 300 where the sheet 300 remains attached to a straw 100, and the filler 100 is added to valley 370.

FIGS. 10 through 14 schematically illustrate the steps of, after edges 362 and 366 are moved apart to provide access to interior bore 380 and smokable filler 1100 has been added to the interior bore 380 of smokable sheet 300, using the connected form mandrel/straw 100 in combination with smokable sheet 300 for rolling a finished rolled smokable product 500.

Figure 11:
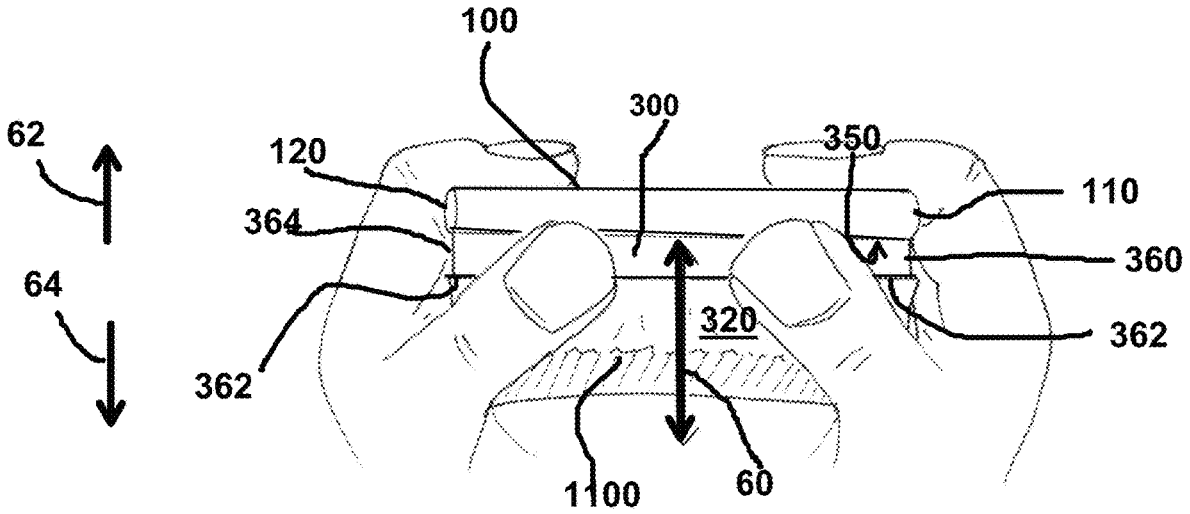
FIGS. 10 through 13 schematically illustrate the steps of using the smokable sheet attached to the straw in the process of rolling a finished smokable product.
Figure 10:
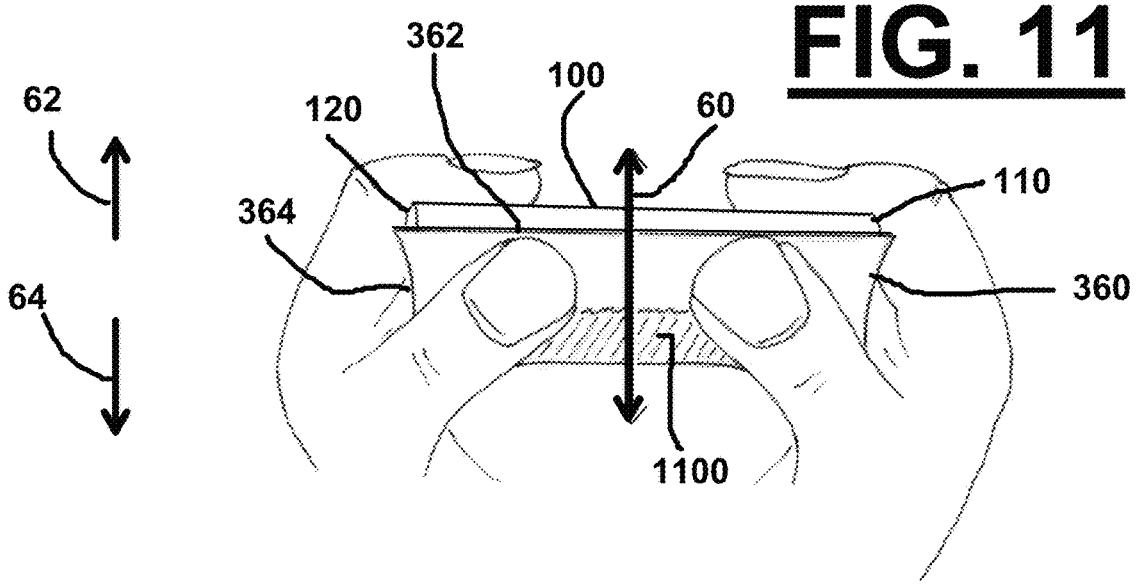
Figure 12:
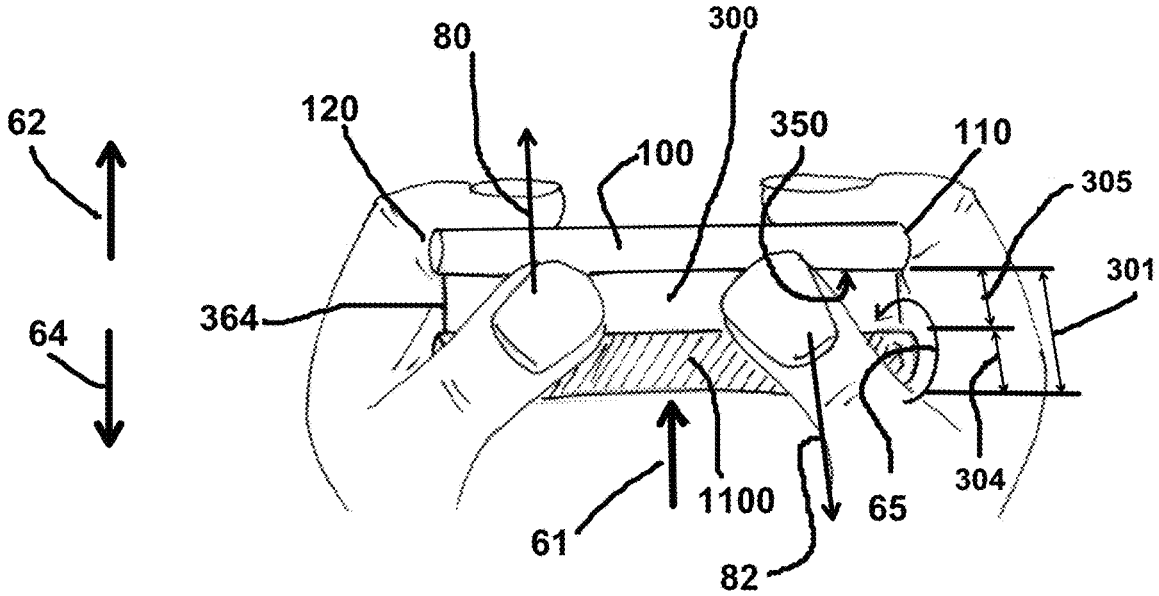

FIGS. 10 and 11 schematically show the initial "overlapping" of edge 362 around the added smokable filler 1100 to interior bore 380 of sheet 300. FIG. 12 shows a complete overlapping of smokable filler 1100, along with the process of rolling the overlapped portion (schematically indicated by arrow 65). Arrows 62 and 64 schematically indicate that a tensile force can be placed in at least part of sheet 300 during this rolling process, with such tensile force being placed by both pushing on connected form mandrel/straw 100 and pulling on sheet 300, while simultaneously rolling sheet 300 and smokable filler 1100.

Dimension 304 indicates the amount of sheet 300 and smokable filler 1100 that has been rolled. Dimension 305 indicates the amount of sheet 300 to be rolled. During the rolling process the user can place a tensile force in sheet 300 by pushing on connected form mandrel/straw 100 (schematically indicated by arrow 80) and pulling on the amount 304 of sheet 300 and smokable filler 1100 that has already been rolled.

Figure 13:
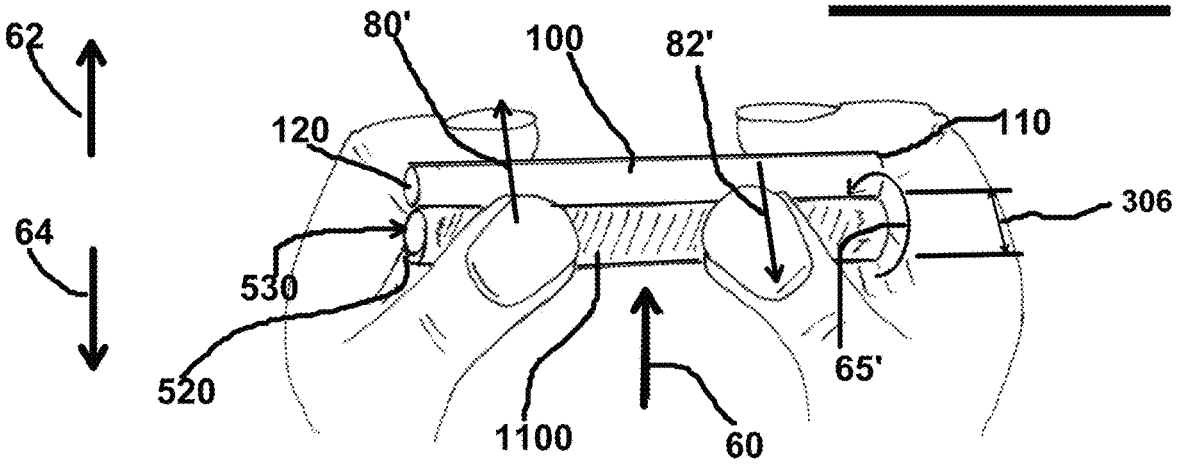

FIG. 13 schematically shows the process of completely rolling (schematically indicated by arrow 65) sheet 300 to where the amount of sheet 300 and smokable filler 1100 that has been rolled (schematically indicated by dimension 306) comes into contact with form mandrel/straw 100. After contact of rolled portion (dimension 306) with form mandrel 100, continued rolling in the direction of arrow 65' places an increased tensile force in sheet 300 (schematically indicated by arrows 80' and 82'), which increased tensile force can more tightly pack the smokable filler 1100 located in the interior bore 380 of now rolled smokable sheet 300 (dimension 306) ultimately resulting in a custom rolled smoking product 500 which has better draw and burn than one that has less tightly packed smokable filler 1100.

Figure 14:
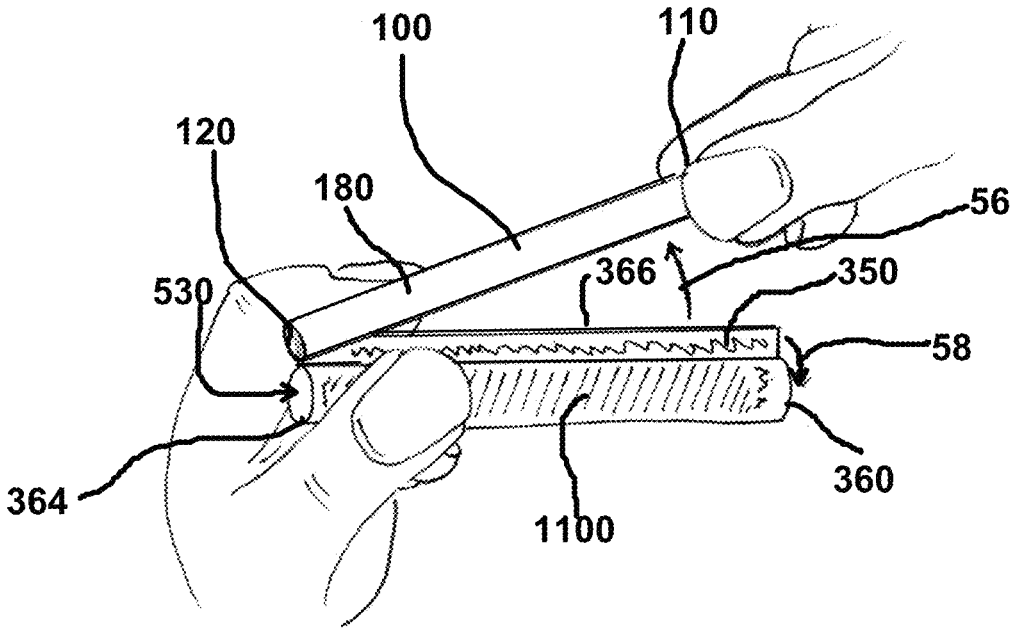
FIG. 14 schematically shows the step of detaching the straw from the smokable sheet after rolling.
Figure 15:
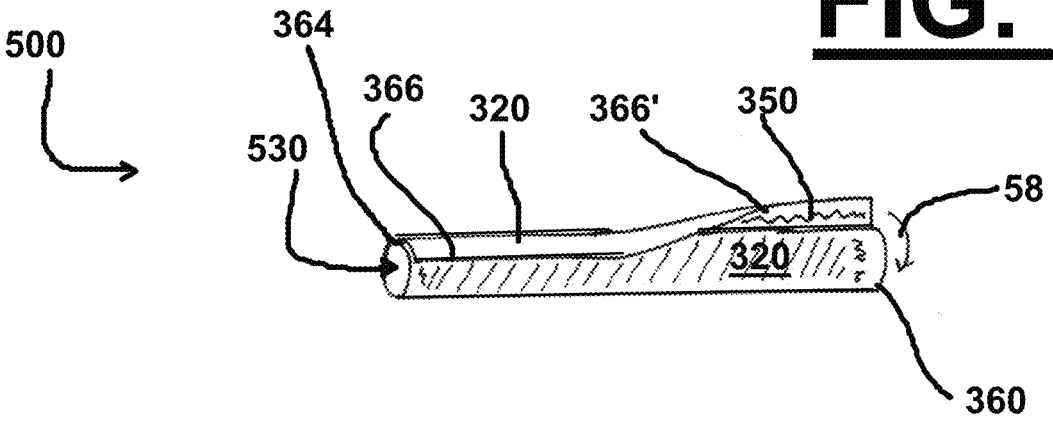
FIG. 15 schematically shows the step of sealing the smokable sheet after rolling.

FIG. 14 schematically shows the step of detaching the form mandrel/straw 100 from the smokable sheet 300 after rolling. Adhesive 350 is preferably such that sheet 300 can be slowly peeled off of form mandrel 100 without tearing sheet 300 during the peeling process. FIG. 15 schematically shows the step of sealing the smokable sheet 300 after rolling. The same glue/adhesive 350 that is peeled off of form mandrel/straw 100 can be used to seal edge 366 of smokable sheet 300 to the outer wall of sheet 300.

In an alternative embodiment sheet 300 can include a perforated line/area 351 immediately below glue line 350 so that sheet 300 can be torn at this perforation line losing only a small portion of sheet 300 to form mandrel 100. In this embodiments a double glue line 350 and 352 with perforated line 351 in between double line 350 and 352 can be used so that glue line 352 can be used to seal new edge 366 to the outer wall of sheet 300 in making the finished rolled smokable product.

Connection by Slot in Form Mandrel

Figure 16:
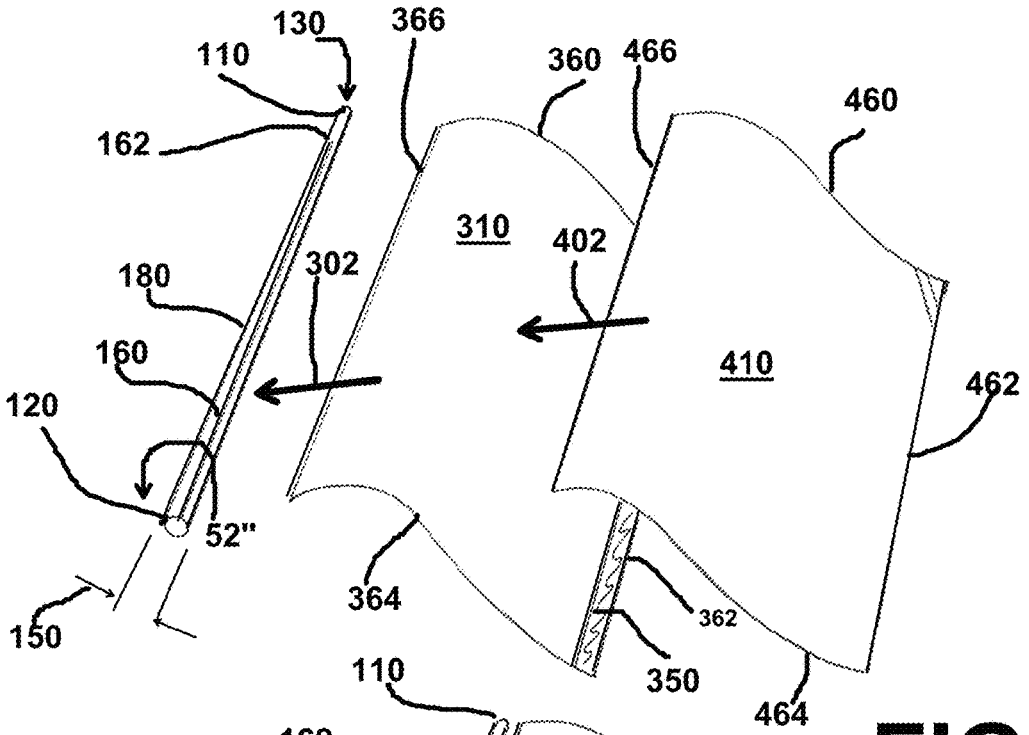
FIG. 16 schematically shows assembly of a first embodiment where the smokable sheet is attached to the straw by being inserted into the bore of the straw through a slit, and with a separating sheet being placed on the smokable sheet.

FIG. 16 schematically shows assembly of a second embodiment where the smokable sheet 300 is attached to the form mandrel/straw 100 by being inserted into the bore 130 of the straw 100 through a longitudinal slit 160 (schematically indicated by arrow 302), and with a separating sheet 400 being placed on the smokable sheet 300 (schematically indicated by arrow 402).

To facilitate a tight finished rolled smokable product, form mandrel/straw 100 preferably will have a diameter 150 which, as will be described below, is small compared to the diameter 550 of finished rolled smokable product 500. In various embodiments diameter 150 is less than 50 percent of diameter 550. In various embodiments diameter 150 is less than 50, 45, 40, 35, 33, 30, 25, 24, 23, 22, 21, 20, 19, 18, 17, 16, 15, 14, 13, 12, 11, 10, 9, 8, 7, 6, 5, 4, 3, 2, and 1 percent of diameter 550. In various embodiments diameter 150 can be with a range of any two of the above referenced percentages of diameter 550.

In various embodiments diameter 150 is less than 20 percent of the length of edge 360 before rolling starts. In various embodiments diameter 150 is less than 20, 19, 18, 17, 16, 15, 14, 13, 12, 11, 10, 9, 8, 7, 6, 5, 4, 3, 2, and 1 percent of the length of edge 360 before rolling. In various embodiments diameter 150 can be with a range of any two of the above referenced percentages of the length of edge 360 before rolling.

In various embodiments the length 170 of slit 160 is at least 50 percent of the length of length 140 of form mandrel/straw 100. In various embodiments length 170 is at least 50, 60, 70, 75, 76, 77, 78, 79, 80, 81, 82, 83, 84, 85, 86, 87, 88, 89, 90, 91, 92, 93, 94, 95, 96, 97, 98, and 99 percent of the length 140 of form mandrel/straw 100. In various embodiments length 170 can be within a range of any two of the above referenced percentages of the length 140 of form mandrel/straw 100.

In this second embodiment glue line 350 for smokable sheet is preferably placed on edge 362 of smokable sheet 300, spaced away from form mandrel 100.

Figure 17:
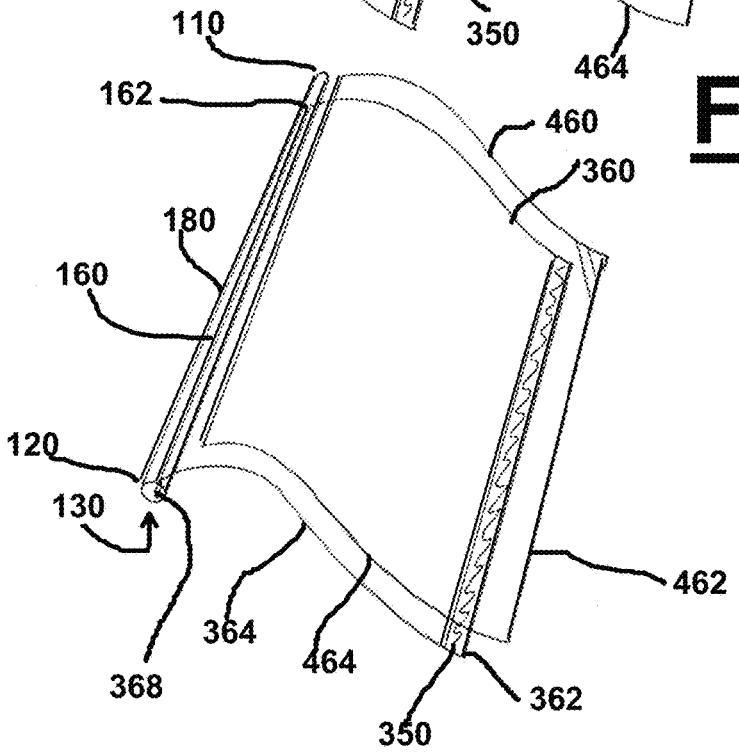
FIG. 17 schematically shows smokable sheet attached to the straw with a separating sheet placed over the smokable sheet, and the assembly being rolled for packaging.

FIG. 17 schematically shows smokable sheet 300 now attached to form mandrel/straw 100 (with edge 366 inserted into slit 160 such that portion 368 is now located in the interior 130 of form mandrel/straw 100); with a separating sheet 400 placed over smokable sheet 300, and the assembly being rolled for packaging, and then showing the assembly being rolled 100 (schematically indicated by arrow 52") to form a rolled assembly 10. FIGS. 18 and 19 show two rolled assemblies 10 and 10' being inserted into a foil and resealable pouch 800. Assembly 10' is constructed substantially similar to assembly 10. Each rolled assembly 10,10' can include pre-rolled smokable sheet 300 which is pre-rolled and attached to form mandrel/straw 100 with a separating sheet 400. The units 10 and 10' are now ready for sale to a consumer who desires to make his on custom made rolled smoking product.

Figure 20:
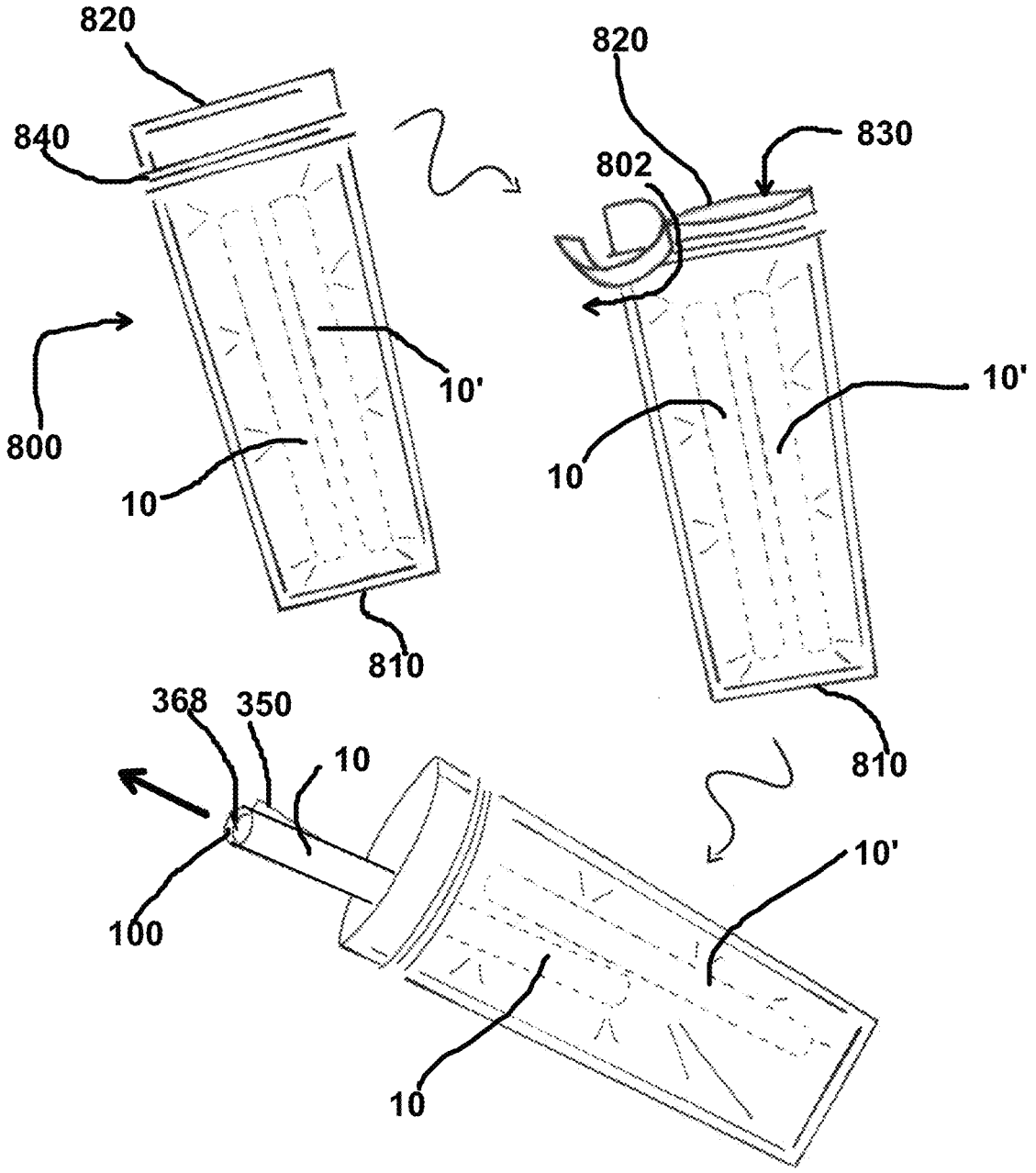
FIG. 20 schematically illustrates the steps to open the foil pouch and remove one of the rolled assemblies.

FIG. 20 schematically illustrates the steps to open the foil pouch 800 pouch and remove one of the rolled assemblies 10 or 10'. Opening of the pouch schematically indicated by arrow 802.

Figure 21:
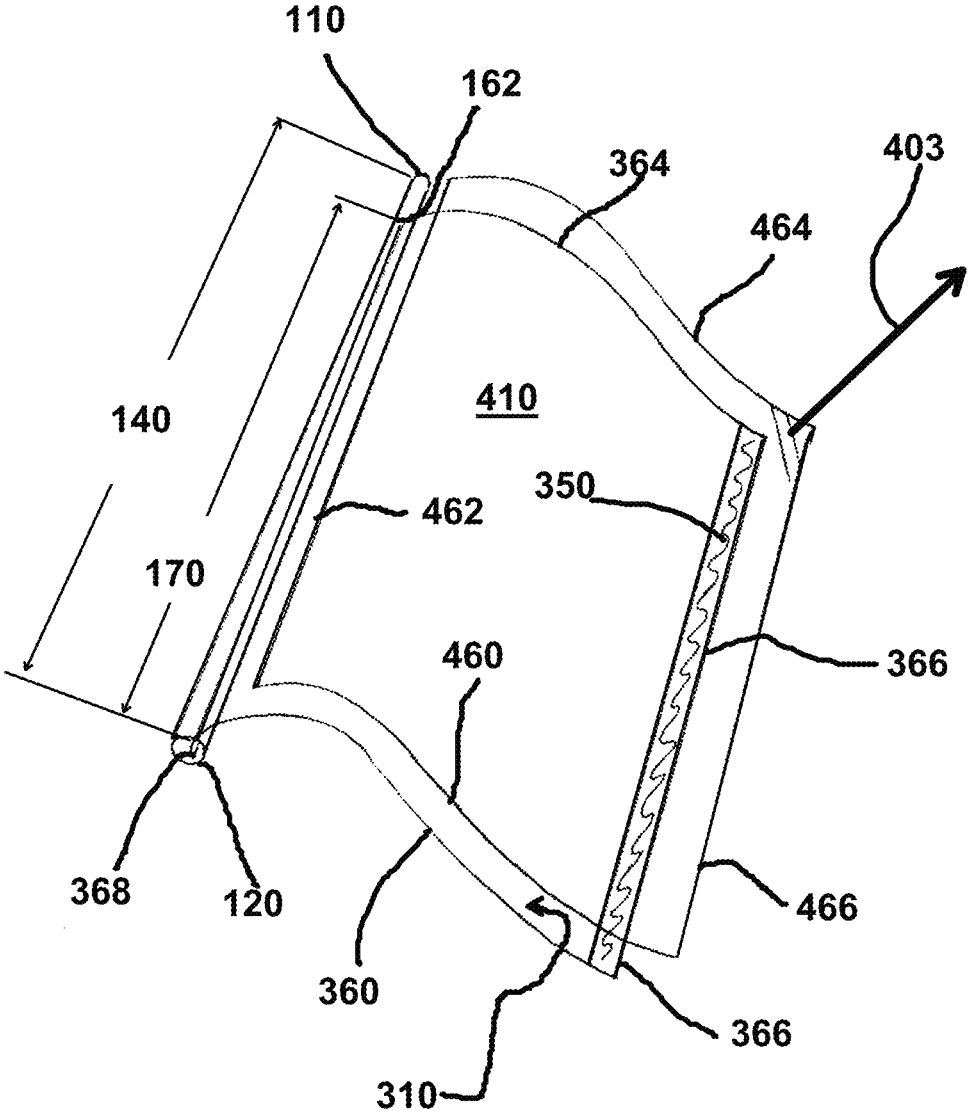
FIG. 21 shows one of the rolled assemblies being unrolled with the removal of the separating sheet.

FIG. 21 shows one of the rolled assemblies 10, with edges 362 and 366 of sheet 300 being moved apart to at least partially unroll sheet 300, and with the removal of separating sheet 400 (schematically indicated by arrow 403). During this moving apart and unrolling process, form mandrel/straw 100 remains connected to smokable sheet 300, such as by slit 160. Also the pre-rolling of smokable sheet 300 about form mandrel/straw 100, with such pre-rolling causing pre-rolled sheet 300 to have a "rolling" memory wherein pre-rolled sheet will tend to want to roll up again into a cylinder.

FIGS. 22 through 26 schematically illustrate the steps of, after edges 362 and 366 are moved apart to provide access to interior bore 380 and smokable filler 1100 has been added to the interior bore 380 of smokable sheet 300, using the connected form mandrel/straw 100 in combination with smokable sheet 300 for rolling a finished rolled smokable product 500.

Figure 22:
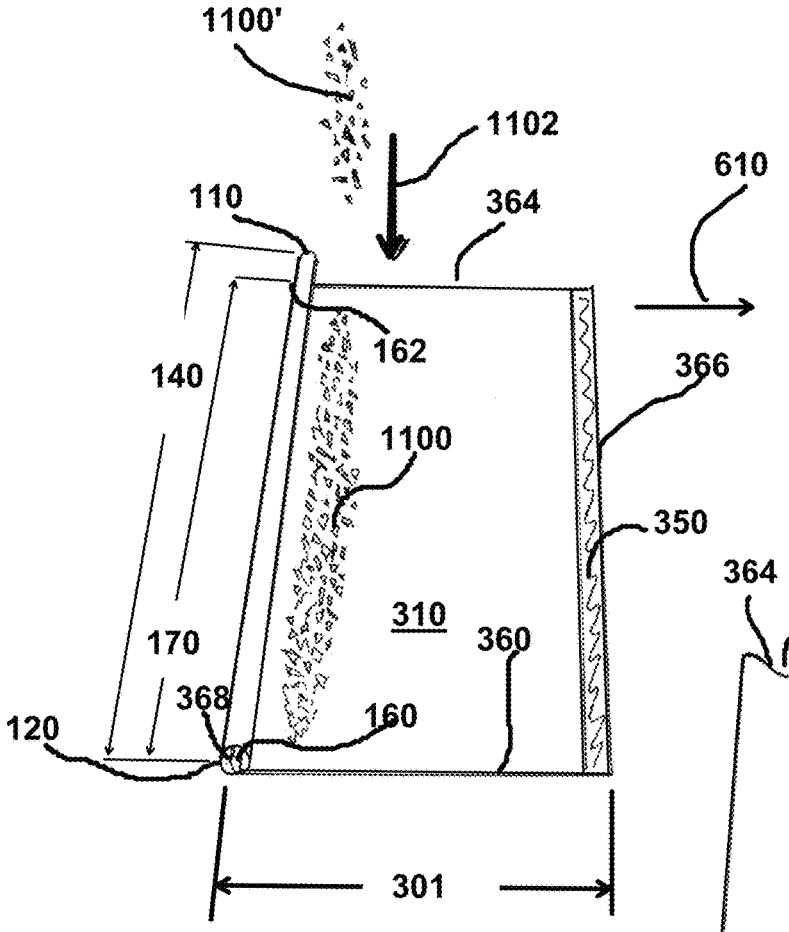
FIG. 22 schematically illustrates the step of adding smokable filler onto the smokable sheet where the sheet remains attached to a straw.

FIG. 22 schematically illustrates the step of adding smokable filler 1100 (schematically indicated by arrow 1102) onto the smokable sheet 300 where the sheet 300 remains attached to a straw 100 via slot 160.

Figure 23:
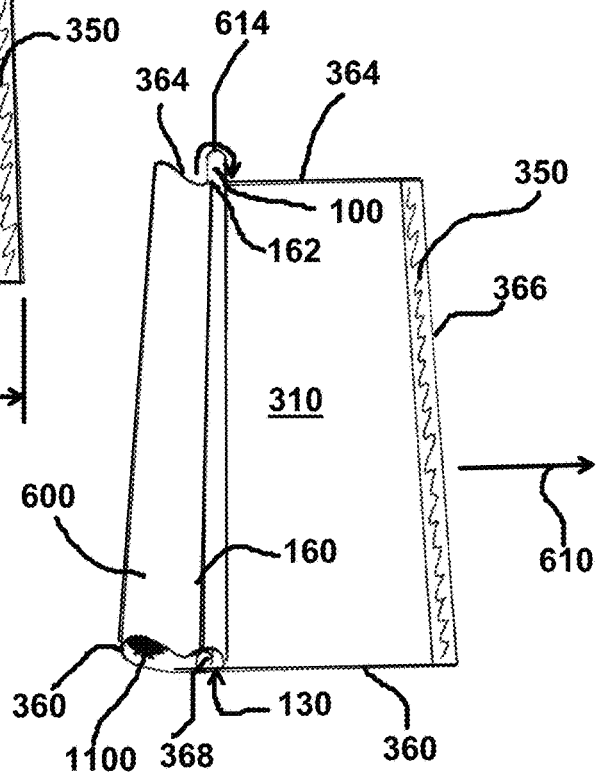
FIGS. 23 through 25 schematically illustrate the steps of using the smokable sheet attached to the straw in the process of rolling a finished smokable product.

FIGS. 22 and 23 schematically show the process of using connected form mandrel/straw 100 to initially "over-lap" edge 362 of smokable sheet 300 around the added smokable filler 1100. FIG. 23 shows a complete overlapping of smokable filler 1100, along with the process of rolling the overlapped portion (schematically indicated by arrow 614). Arrows 610 and 612 schematically indicate that a tensile force can be placed in at least part of sheet 300 during this rolling process, with such tensile force being placed by both pulling on form mandrel/straw 100 in the direction of arrow 614 while simultaneous maintaining the position of edge 366 of sheet 300 (or also pulling on edge 366 in the direction of arrow 610), all while simultaneously rolling sheet 300 and smokable filler 1100 (schematically indicated by arrow 614). Dimension 304 indicates the amount of sheet 300 and smokable filler 1100 that has been rolled. Dimension 305 indicates the amount of sheet 300 to be rolled.

Figure 24:
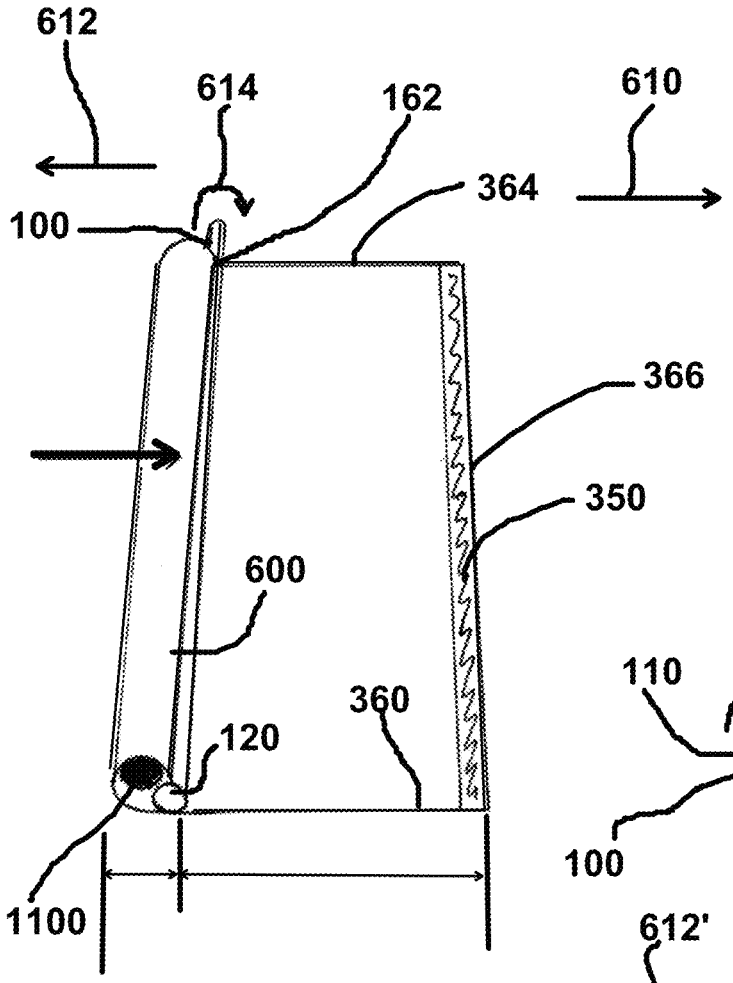
Figure 25:
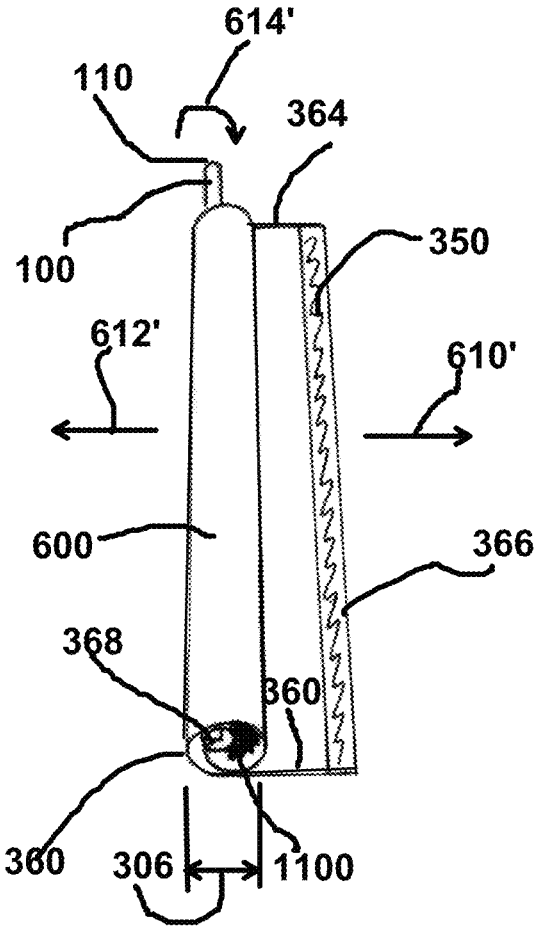

FIGS. 24 and 25 schematically illustrate the steps of using the smokable sheet 300 attached to form mandrel/straw 100 in the process of rolling a finished rolled smokable product 500. FIG. 25 schematically shows the completion of the rolling process (schematically indicated by arrow 614) of sheet 300 to where the form mandrel/straw 100 can be detached from sheet 300. Continued twisting of form mandrel/straw 100 in the direction of arrow 614', while simultaneous maintaining the position of edge 366 of sheet 300 (or also pulling on edge 366 in the direction of arrow 610), places an increased tensile force in sheet 300 (schematically indicated by arrows 610' and 612'), which increased tensile force can more tightly pack the smokable filler 1100 located in the interior bore 380 of now rolled smokable sheet 300 (decreasing dimension 306) ultimately resulting in a custom rolled smoking product 500 which has better draw and burn than one that has less tightly packed smokable filler 1100.

Figures 26A, 26B, 26C:
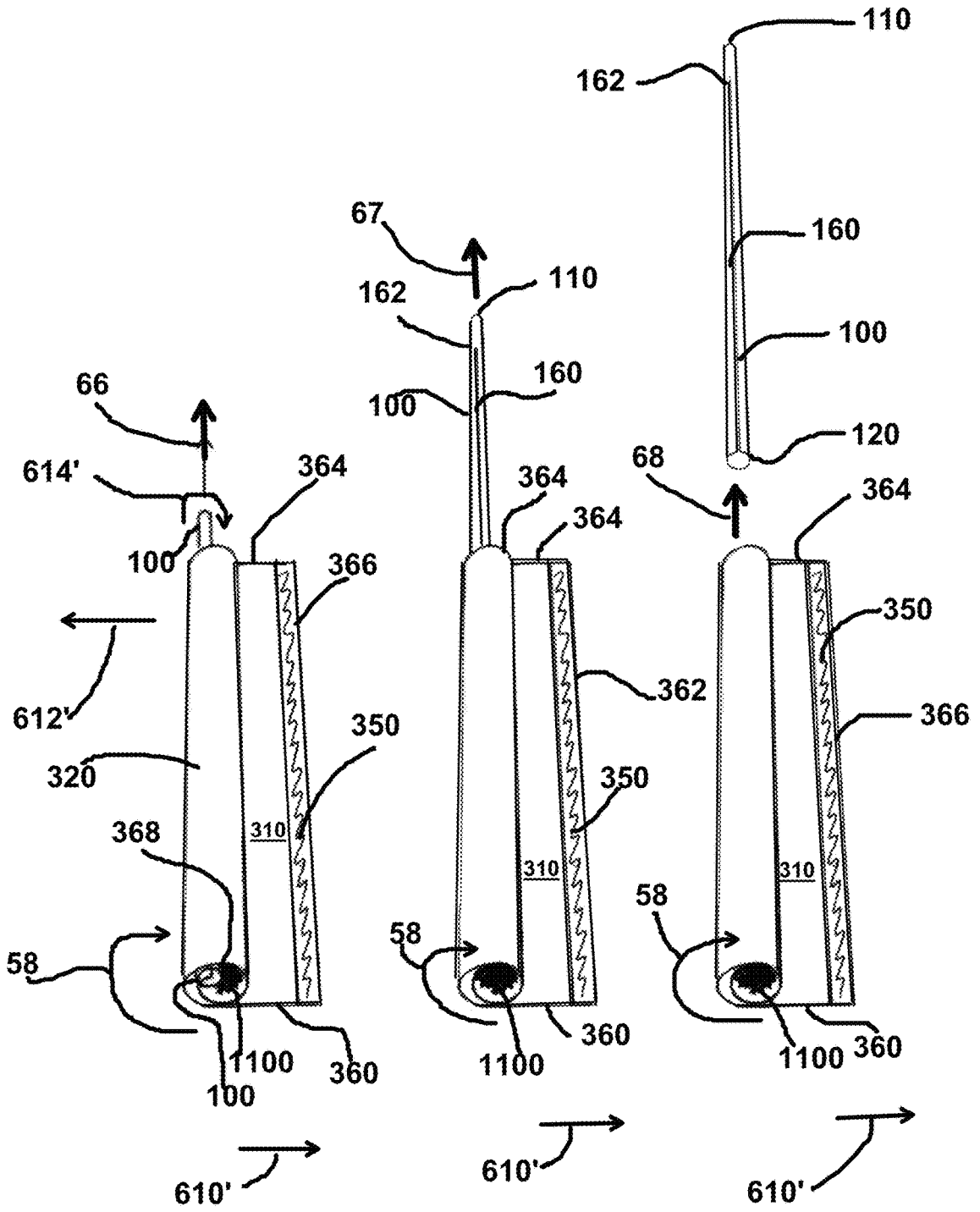
FIGS. 26A, 26B, and 26C schematically shows the step of detaching the straw from the smokable sheet after rolling by sliding the straw out of the rolled smoking product.

FIGS. 26A, 26B, and 26C schematically shows the step of detaching the form mandrel/straw 100 from the smokable sheet 300 after rolling by sliding form mandrel 100 out of the rolled smoking product 500 (schematically indicated by arrows 66, 67, and 68). During this sliding out process, the rolled portion of smokable sheet 300 should be kept tight and from unrolling which is schematically indicated by arrow 58 in these figures.

Figure 27:
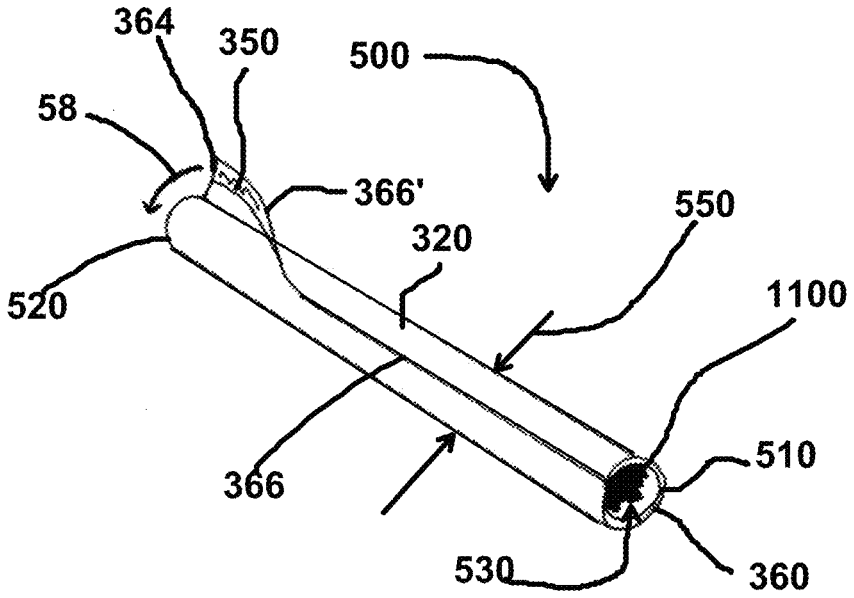
FIG. 27 schematically shows the step of sealing the smokable sheet after rolling.

FIG. 27 schematically shows the step of sealing the smokable sheet 300 after rolling. Glue/adhesive 350 can be used to seal edge 366 of smokable sheet 300 to the outer wall of sheet 300.

Hollow Tube and Insertable Rod

FIGS. 28-34 show a third embodiment which comprises a hollow tube portion 910 and insertable smokable insert 950. FIG. 28 is a perspective view of a hollow receiving portion 910 which includes first end 910, second end 914, filter 920, and receiving volume 930. In this embodiment insertable smokable insert can be received by receiving portion 910.

Figure 31:
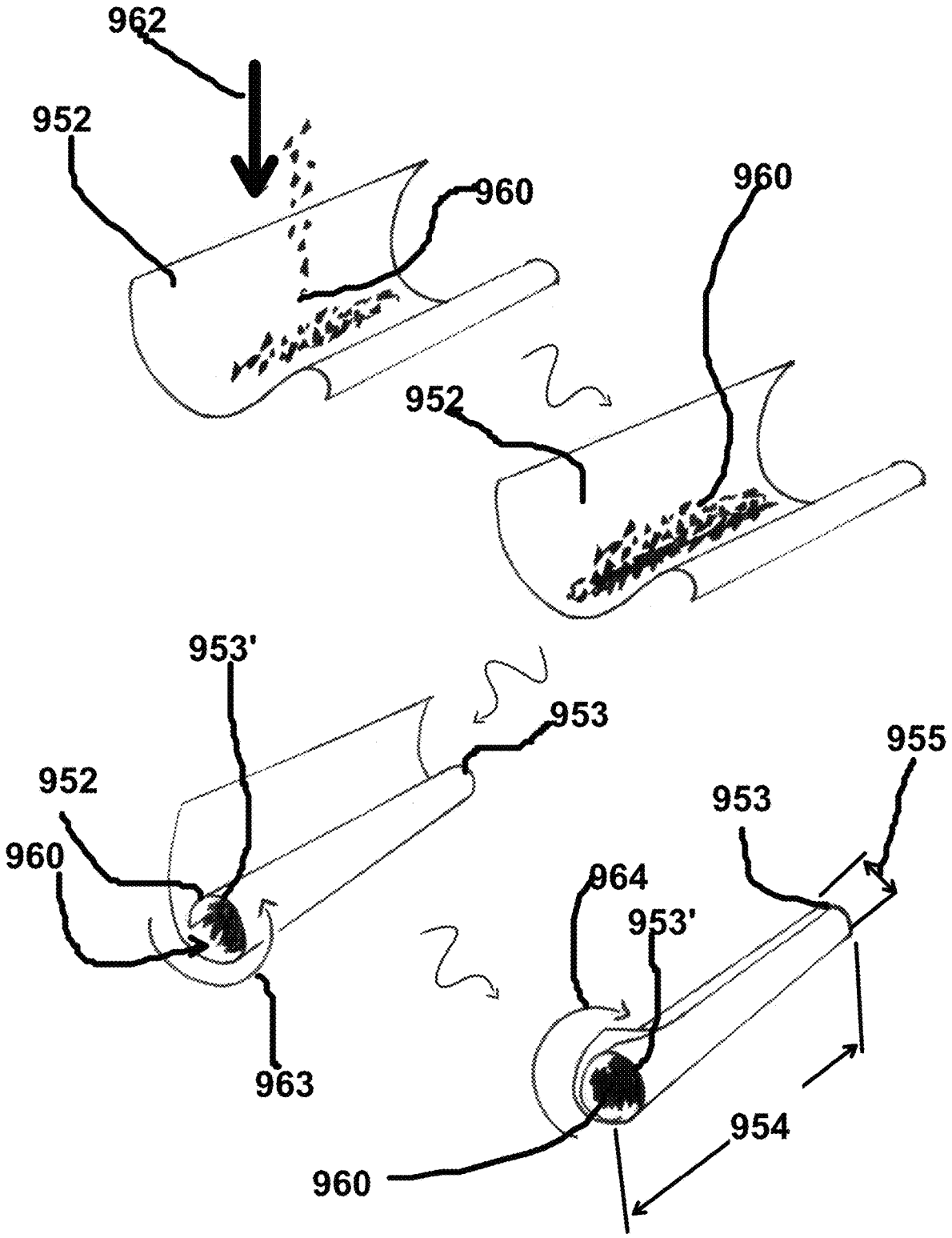
FIG. 31 are various perspective views showing the use of a sheet and smokable filler in making a smokable insert.

FIG. 29 is a perspective view of a smokable sheet 952 which can be used in making a smokable insert 950. Sheet 952 can have end 953, length 954, and diameter 955. FIG. 30 is a perspective view of smokable filler 1100 which can be inserted into longitudinal opening or cavity 958 of smokable insert. FIG. 31 are various perspective views showing the use of a sheet 952 and smokable filler 1100 in making a smokable insert 950.

Figure 32:
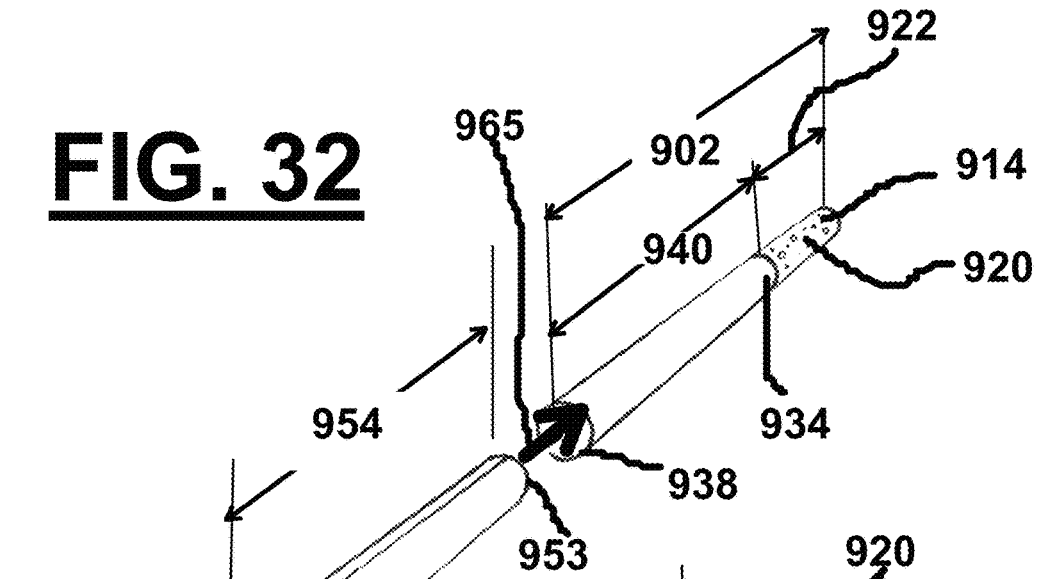
FIG. 32 is a perspective view of the smokable insert about to be inserted into the hollow receiving portion.
Figure 33:
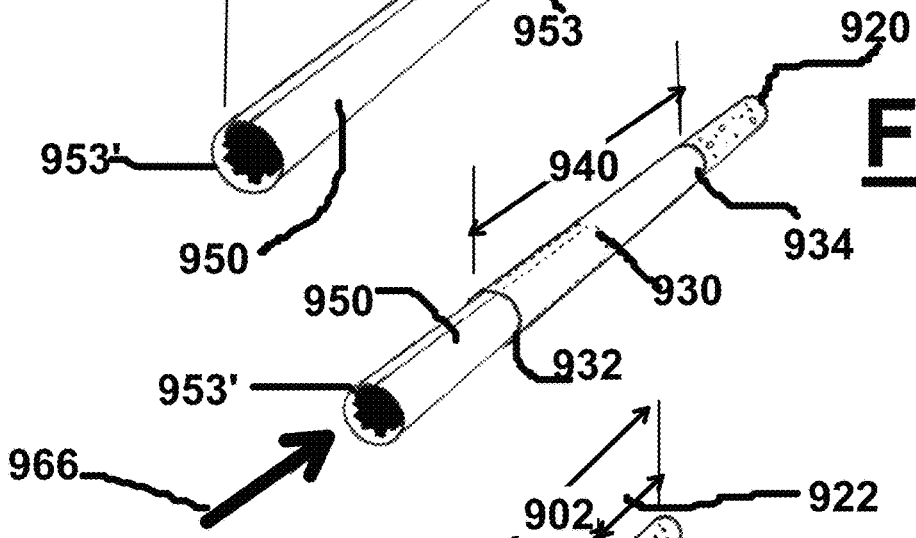
FIG. 33 is a perspective view of the smokable insert partially inserted into the hollow receiving portion.
Figure 34:
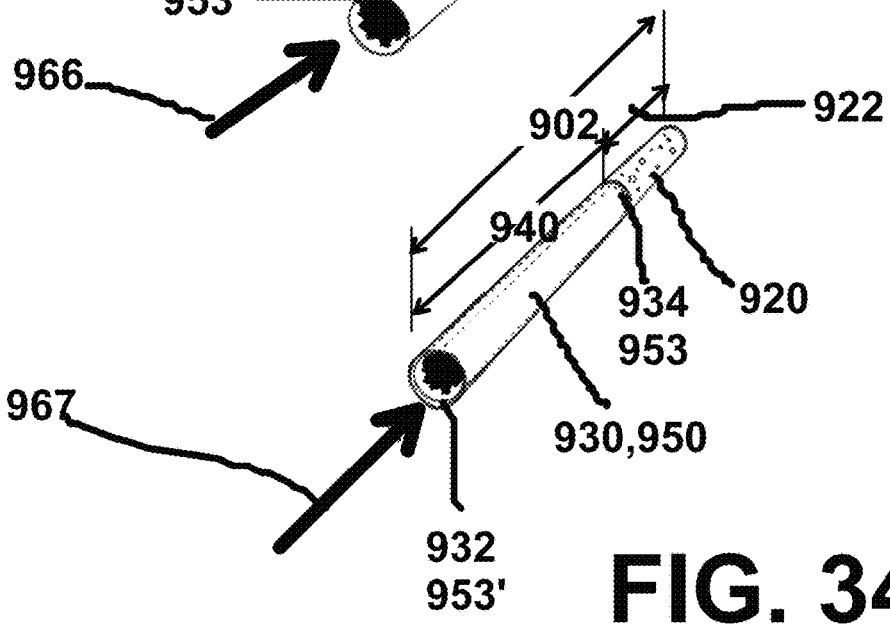
FIG. 34 is a perspective view of the smokable insert fully inserted into the hollow receiving portion.

FIG. 32 is a perspective view of the smokable insert 950 about to be inserted into the hollow receiving portion 930 of hollow tube 910. FIG. 33 is a perspective view of the smokable insert 950 partially inserted into the hollow receiving portion 930. FIG. 32 is a perspective view of the smokable insert 950 fully inserted into the hollow receiving portion 950. After full insertion a finished smoking product is created and can be smoked.

The following is a Table of Reference Numerals used in this patent application:

TABLE OF REFERENCE NUMERALS:

| REFERENCE NUMBER | DESCRIPTION |
|---|---|
| 10 | unit |
| 50 | arrow |
| 52 | arrow |
| 54 | arrow |
| 56 | arrow |
| 57 | arrow |
| 58 | arrow |
| 60 | arrow |
| 61 | arrow |
| 62 | arrow |
| 64 | arrow |
| 65 | arrow |
| 66 | arrow |
| 67 | arrow |
| 68 | arrow |
| 70 | arrow |
| 72 | arrow |
| 80 | arrow |
| 82 | arrow |
| 100 | straw |
| 110 | first end |
| 120 | second end |
| 130 | longitudinal bore |
| 140 | length of straw |
| 150 | diameter of straw |
| 160 | slit |
| 162 | edge of slit |
| 170 | length of slit |
| 180 | outer surface of straw |
| 190 | adhesive |
| 300 | smokable sheet |
| 301 | distance from straw |
| 302 | arrow |
| 304 | rolled portion |
| 305 | portion remaining to be rolled |
| 306 | completion of rolling step |
| 310 | first face |
| 312 | dimension |
| 320 | second face |
| 322 | dimension |
| 350 | adhesive line |
| 352 | dimension |
| 360 | first side |
| 361 | dimension |
| 362 | second side |
| 363 | dimension |
| 364 | third side |
| 365 | dimension |
| 366 | fourth side |
| 368 | portion of smokable sheet inserted into interior bore of straw |
| 367 | dimension |
| 370 | reservoir/valley |
| 372 | arrow |
| 380 | interior bore |
| 400 | separating sheet |
| 402 | arrow |
| 410 | first face |
| 412 | dimension |
| 420 | second face |
| 422 | dimension |
| 460 | first side |
| 461 | dimension |
| 462 | second side |
| 463 | dimension |
| 464 | third side |
| 465 | dimension |
| 466 | fourth side |
| 467 | dimension |
| 500 | finished smoking product |
| 510 | first end |
| 520 | second end |
| 530 | longitudinal bore |
| 550 | diameter |
| 600 | overlapped portion |
| 610 | arrow |
| 612 | arrow |

-continued

TABLE OF REFERENCE NUMERALS:

| REFERENCE NUMBER | DESCRIPTION |
|---|---|
| 614 | arrow |
| 800 | package/wrapper |
| 802 | arrow |
| 810 | closed end |
| 820 | open end |
| 830 | interior |
| 840 | seal |
| 900 | finished herbal smoking product |
| 902 | dimension |
| 910 | hollow tube portion |
| 912 | first end |
| 914 | second end |
| 920 | filter |
| 922 | dimension |
| 930 | receiving volume |
| 932 | first end |
| 934 | second end |
| 938 | longitudinal cavity or opening |
| 940 | length of hollow tube portion |
| 950 | filler insert |
| 952 | sheet |
| 953 | end |
| 954 | length |
| 955 | diameter |
| 958 | longitudinal cavity or opening |
| 960 | filler |
| 962 | arrow |
| 963 | arrow |
| 964 | arrow |
| 965 | arrow |
| 966 | arrow |
| 967 | arrow |
| 1100 | smokable filler material |
| 1102 | arrow |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A kit for creating a custom rolled smokable product, comprising:

(a) at least one form mandrel having a mandrel length;

(b) at least one smokable sheet, the at least one smokable sheet being in a partially pre-rolled state and having a pre-rolled length, with a longitudinal containment volume and edges that can be moved apart to provide access to the containment volume for adding a smokable filler to the longitudinal containment volume;

(c) the at least one form mandrel being connected to and supporting the at least one smokable sheet in the partially pre-rolled state, wherein the at least one form mandrel has an interior and an opening and the connection is made by the at least one sheet being partially inserted into the interior through the opening, and wherein the mandrel length is greater than the pre-rolled length; and (d) the smokable filler added to the longitudinal containment volume when the at least one form mandrel is connected to and supporting the at least one smokable sheet, wherein the connected form mandrel substantially remains in the longitudinal containment volume, wherein the smokable filler fills the longitudinal containment volume along the entire pre-rolled length, wherein the mandrel and smokable filler are in contact with each other along the entire pre-rolled length, wherein the form mandrel and smokable filler are rolled around each other during which time rotation of the form mandrel both rotates and creates a tensile force in the sheet, wherein after rolling the form mandrel can be disconnected from the at least one smokable sheet and/or custom rolled smoking article by sliding the form mandrel relative to at least one smokable sheet.

2. The kit of claim 1, wherein the at least one smokable sheet has an edge that overlaps around the smokable filler.

3. The kit of claim 1, wherein the at least one smokable sheet has an edge that overlaps around both form mandrel and the smokable filler.

4. The kit of claim 1, wherein the smokable filler is in contact with the form mandrel.

5. The kit of claim 1, wherein the at least one smokable sheet is wrapped about the smokable filler and the form mandrel.

6. The kit of claim 1, wherein the at least one smokable sheet is wrapped about the form mandrel.

7. A method of constructing a rolled smokable product comprising the steps of:

(a) obtaining a sheet of smokable material wherein the sheet is detachably connected to a form mandrel having a mandrel length, and the sheet is rolled into a shaped tube having a tube length, and that has an interior bore and at least two edges that can be moved apart providing access to the interior bore so that smokable fill material can be added to the interior bore, wherein the mandrel length is greater than the tube length;

(b) wherein, without filling the interior bore with smokable fill material, the shaped tube and detachably connected form mandrel are packaged inside a wrapper for sale to a consumer, with the form mandrel supporting the pre-rolled sheet in the rolled state inside the wrapper;

(c) constructing a rolled smokable product from the shaped tube of step "b" by removing the shaped tube and the detachably connected form mandrel from the wrapper, moving apart the two edges, and filling the interior bore with smokable fill material along the tube length wherein the smokable fill material is in contact with the form mandrel along the entire tube length, and rotating the detachably connected form mandrel to roll the sheet and smokable fill material into a rolled smokable product, wherein the form mandrel and smokable fill material remain in contact along the entire tube length during this step "c"; and (d) wherein the at least one form mandrel is rotated during step "c" to create tensile force in the sheet of material and also overlap the smokable sheet, smokable fill material, and form mandrel while rolling.

8. The method of claim 7, wherein in step "a' the detachable connection is made by a frictionally squeezing connection.

9. The method of claim 8, wherein the frictionally squeezing connection includes a slot frictionally squeezing the sheet of smokable material.

10. The method of claim 7, wherein after step "d" disconnecting the form mandrel from the sheet of smokable material.

* * * * *